US011267247B2

(12) United States Patent
Murayama et al.

(10) Patent No.: US 11,267,247 B2
(45) Date of Patent: Mar. 8, 2022

(54) LIQUID EJECTING APPARATUS AND MAINTENANCE METHOD FOR LIQUID EJECTING APPARATUS

(71) Applicant: SEIKO EPSON CORPORATION, Tokyo (JP)

(72) Inventors: Masato Murayama, Matsumoto (JP); Atsushi Yoshida, Matsumoto (JP); Kazushi Arafuka, Matsumoto (JP); Mizuki Yokouchi, Okaya (JP); Masanobu Yamaguchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/866,048

(22) Filed: May 4, 2020

(65) Prior Publication Data

US 2020/0353750 A1 Nov. 12, 2020

(30) Foreign Application Priority Data

May 7, 2019 (JP) ..... JP2019-087657

(51) Int. Cl.
*B41J 2/165* (2006.01)

(52) U.S. Cl.
CPC ..... *B41J 2/16517* (2013.01); *B41J 2/16544* (2013.01); *B41J 2002/1655* (2013.01)

(58) Field of Classification Search
CPC ..... B41J 2/1651; B41J 2/16544; B41J 2002/1655; B41J 2/21; B41J 2/16535
See application file for complete search history.

(56) References Cited

U.S. PATENT DOCUMENTS

| | | | | |
|---|---|---|---|---|
| 7,188,927 | B2 * | 3/2007 | Anderson, Jr | B41J 2/16535 347/33 |
| 9,943,886 | B2 * | 4/2018 | Atwood | B08B 1/008 |
| 2009/0284566 | A1 | 11/2009 | Suzuki et al. | |
| 2012/0236054 | A1 | 9/2012 | Ito et al. | |
| 2014/0125734 | A1 | 5/2014 | Kobayashi | |
| 2014/0198156 | A1 | 7/2014 | Murayama et al. | |
| 2014/0247305 | A1 | 9/2014 | Fukuda et al. | |
| 2015/0035900 | A1 | 2/2015 | Mano | |

(Continued)

FOREIGN PATENT DOCUMENTS

| | | |
|---|---|---|
| JP | 2005-111677 | 4/2005 |
| JP | 2006-095706 | 4/2006 |
| JP | 2008-168247 | 7/2008 |

(Continued)

*Primary Examiner* — Geoffrey S Mruk
(74) *Attorney, Agent, or Firm* — Workman Nydegger

(57) ABSTRACT

A liquid ejecting apparatus includes a wiping mechanism that includes a wiping portion configured to move in a wiping direction, in which a first nozzle surface and a second nozzle surface each provided with nozzles of a liquid ejecting portion are aligned, and to wipe the first nozzle surface and the second nozzle surface, and an isolation region in which the wiping portion is not brought into contact with the first nozzle surface and the second nozzle surface when a gap between the first and second nozzle surfaces and the wiping portion in an ejecting direction of liquid from the nozzles is a contact interval at which the first nozzle surface and the second nozzle surface are wiped is provided between the first nozzle surface and the second nozzle surface in the wiping direction.

5 Claims, 11 Drawing Sheets

(56) References Cited

U.S. PATENT DOCUMENTS

| | | | |
|---|---|---|---|
| 2017/0313085 | A1 | 11/2017 | Profaca et al. |
| 2017/0341374 | A1 | 11/2017 | Nishiyama et al. |

FOREIGN PATENT DOCUMENTS

| | | |
|---|---|---|
| JP | 2009-274285 | 11/2009 |
| JP | 2012-106442 | 6/2012 |
| JP | 2014-091319 | 5/2014 |
| JP | 2014-133386 | 7/2014 |
| JP | 2014-168853 | 9/2014 |
| JP | 2015-030098 | 2/2015 |
| JP | 2015-221583 | 12/2015 |
| JP | 2017-209950 | 11/2017 |

* cited by examiner

LIQUID EJECTING APPARATUS AND MAINTENANCE METHOD FOR LIQUID EJECTING APPARATUS

The present application is based on, and claims priority from JP Application Serial Number 2019-087657, filed May 7, 2019, the disclosure of which is hereby incorporated by reference herein in its entirety.

BACKGROUND

1. Technical Field

The present disclosure relates to a liquid ejecting apparatus such as a printer and a maintenance method for a liquid ejecting apparatus.

2. Related Art

There is an image forming device as an example of the liquid ejecting apparatus as in JP-A-2015-221583, for example. The image forming device includes a head for black ink configured to eject black liquid droplets, a head for color ink configured to eject color liquid droplets, a carriage on which the head for black ink and the head for color ink are mounted, and a wiper member as an example of a wiping portion configured to wipe a nozzle surface. The head for black ink and the head for color ink are disposed at the same position in a sub-scanning direction as an example of a transport direction and are aligned in a main scanning direction as an example of a scanning direction.

The carriage moves in the main scanning direction in which the head for black ink and the head for color ink are aligned and causes the wiper member to wipe a first nozzle surface included in the head for black ink and a second nozzle surface included in the head for color ink. Therefore, when one of the first nozzle surface and the second nozzle surface is to be wiped, it is necessary to wipe the other nozzle surface.

SUMMARY

According to an aspect of the present disclosure, there is provided a liquid ejecting apparatus including: a liquid ejecting portion on which a first nozzle surface and a second nozzle surface are provided at an interval, the first nozzle surface and the second nozzle surface each being provided with nozzles that eject liquid; a wiping mechanism that has a wiping portion configured to wipe the first nozzle surface and the second nozzle surface and in which the wiping portion moves in a wiping direction in which the first nozzle surface and the second nozzle surface are aligned to perform wiping, and a gap changing mechanism configured to change a gap between the first and second nozzle surfaces and the wiping portion in an ejecting direction, in which the liquid is ejected from the nozzles, between a contact interval at which the first nozzle surface and the second nozzle surface are wiped and a non-contact interval at which the first nozzle surface and the second nozzle surface are not in contact with the wiping portion, in which the interval includes an isolation region in which the wiping portion is not brought into contact with the first nozzle surface and the second nozzle surface when the gap is the contact interval, and which is provided between the first nozzle surface and the second nozzle surface in the wiping direction.

According to another aspect of the present disclosure, there is provided a maintenance method for a liquid ejecting apparatus that includes a liquid ejecting portion on which a first nozzle surface and a second nozzle surface are provided at an interval, the first nozzle surface and the second nozzle surface each being provided with nozzles that eject liquid, a wiping mechanism that has a wiping portion configured to wipe the first nozzle surface and the second nozzle surface and in which the wiping portion moves in a wiping direction in which the first nozzle surface and the second nozzle surface are aligned to perform wiping, and a gap changing mechanism configured to change a gap between the first and second nozzle surfaces and the wiping portion in an ejecting direction, in which the liquid is ejected from the nozzles, between a contact interval at which the first nozzle surface and the second nozzle surface are wiped and a non-contact interval at which the first nozzle surface and the second nozzle surface are not in contact with the wiping portion, in which the interval includes an isolation region in which the wiping portion is not brought into contact with the first nozzle surface and the second nozzle surface when the gap is the contact interval, and which is provided between the first nozzle surface and the second nozzle surface in the wiping direction, the method including, when the first nozzle surface positioned between a standby position and the second nozzle surface in the wiping direction is wiped, causing the wiping portion to move from the standby position toward the second nozzle surface, causing the wiping portion to pass through the first nozzle surface at the contact interval to wipe the first nozzle surface, then changing the gap to the non-contact interval in the isolation region, and causing the wiping portion to move toward the standby position.

DESCRIPTION OF EXEMPLARY EMBODIMENTS

Hereinafter, an embodiment of a liquid ejecting apparatus and a maintenance method for a liquid ejecting apparatus will be described with reference to drawings. The liquid ejecting apparatus is, for example, an ink jet printer configured to perform printing by ejecting ink, which is an example of a liquid, onto a medium such as a paper.

Figure 1:
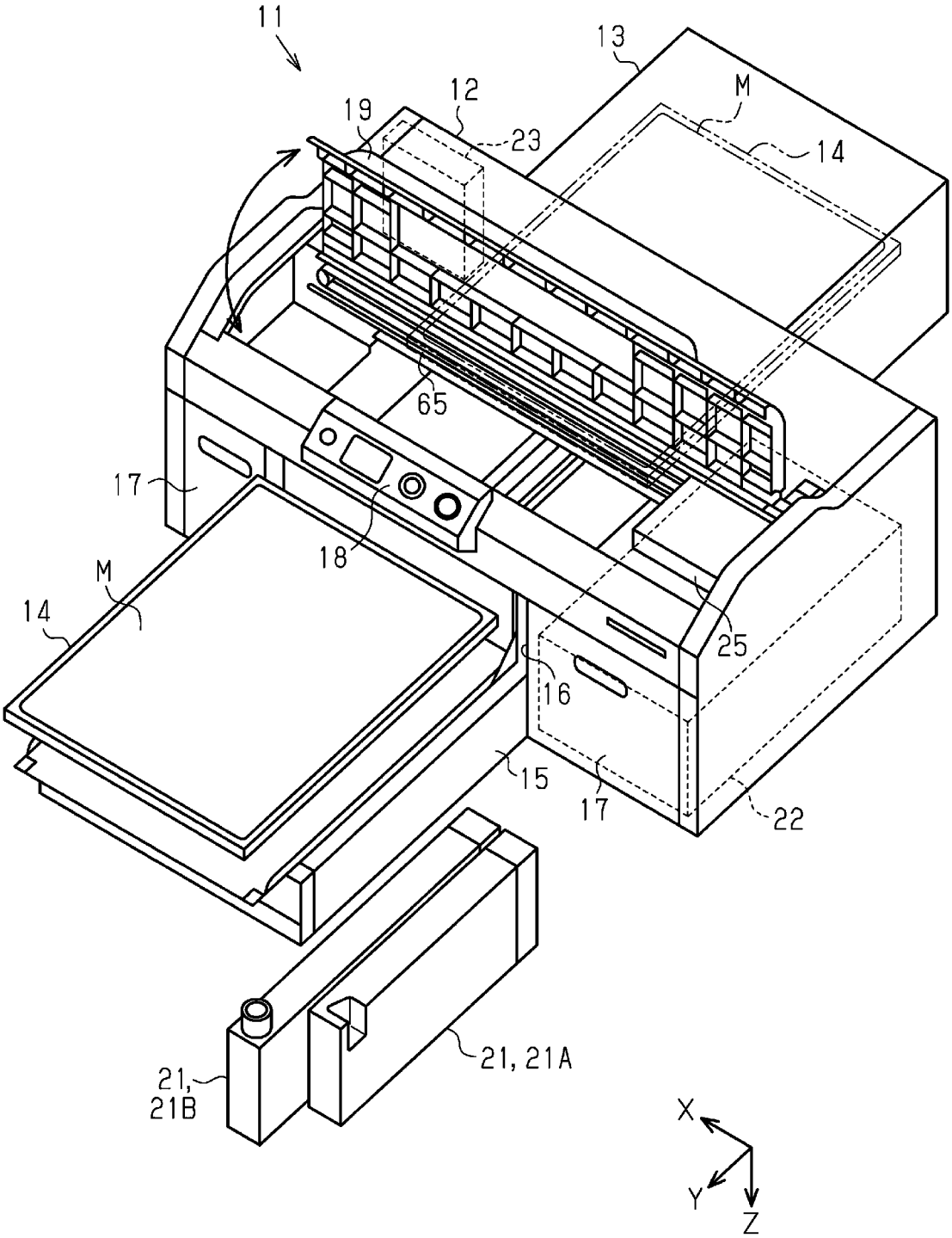
FIG. 1 is a perspective view of a liquid ejecting apparatus according to an embodiment.

As illustrated in FIG. 1, a liquid ejecting apparatus 11 includes a main body 12 with a substantially rectangular box shape, an accommodation portion 13 provided so as to project from the main body 12, a placement portion 14 capable of moving in a state in which a medium M is placed thereon, and a transport portion 15 configured to move the placement portion 14. The medium M may be, for example, a paper, a plastic film, a plate material, a hard panel, a cardboard, a cloth, a clothing such as a T-shirt.

In the drawing, a direction of gravity is represented by a Z axis, and directions that follow a horizontal surface are represented by an X axis and a Y axis on the assumption that the liquid ejecting apparatus 11 is placed on the horizontal surface. The X axis, the Y axis, and the Z axis perpendicularly intersect each other. In the embodiment, the direction that is parallel to the X axis will also be referred to as a scanning direction X, the direction that is parallel to the Y axis will also be referred to as a transport direction Y, and a direction that is parallel to the Z axis will also be referred to as an ejecting direction Z.

The accommodation portion 13, the main body 12, and the transport portion 15 are aligned in the transport direction Y. The main body 12 is provided with a transport inlet 16 through which the placement portion 14 is transported into the main body 12. The liquid ejecting apparatus 11 may include a front surface covers 17 provided on both sides of the transport inlet 16 in the scanning direction X, an operation panel 18 configured to be operated by a user, and a maintenance cover 19 that can be opened and closed.

The transport inlet 16 is larger than the placement portion 14 in the scanning direction X and the ejecting direction Z. A space that is larger than the placement portion 14 in the scanning direction X and the ejecting direction Z is formed in the transport direction Y inside the main body 12 and the accommodation portion 13.

The placement portion 14 reciprocates between a placement position represented by the solid line in FIG. 1 and a printing start position represented by the two-dotted dashed line in FIG. 1 in the transport direction Y and in the direction that is opposite to the transport direction Y. The placement position is a position outside the main body 12 at which the user places the medium M on the placement portion 14. The placement portion 14 moves from the placement position toward the direction that is opposite to the transport direction Y and moves up to the printing start position. The printing start position is a position at which the placement portion 14 is temporarily stopped before moving the placement portion 14 in the transport direction Y. The placement portion 14 moves in the transport direction Y from the printing start position, and printing is performed on the medium M at a printing position located between the printing start position and the placement position.

The front surface cover 17 may be provided such that the front surface cover 17 is located at a closed position illustrated in FIG. 1 and an opened position, which is not illustrated in the drawing. The front surface cover 17 located in the closed position is turned such that an upper end thereof falls downstream in the transport direction Y around a turning shaft provided at a lower end of the front surface cover 17 along the X axis, for example, which is not illustrated, and moves to the opened position.

The liquid ejecting apparatus 11 may include an attachment portion 22 to which a liquid supply source 21 that stores a liquid can be attached. The front surface cover 17 located at the closed position covers the attachment portion 22. The front surface cover 17 located at the opened position causes the attachment portion 22 to be exposed. The liquid supply source 21 may be, for example, a cartridge-type liquid accommodation body 21A that is detachably attached to the liquid ejecting apparatus 11 or may be a liquid tank 21B capable of replenishing a liquid.

A plurality of liquid supply sources 21 may be attached to the attachment portion 22. The liquid supply sources 21 are provided at least for the respective types of liquid. The types of liquid include an ink containing a coloring material, a storage liquid that does not contain a coloring material, a treatment solution for promoting ink fixation, and the like. When the plurality of liquid supply sources 21 supply ink with different colors, the liquid ejecting apparatus 11 can perform color printing.

Colors of the ink include, for example, cyan, magenta, yellow, black, white, and the like. Color printing may be performed using four colors, namely cyan, magenta, yellow, and black or may be performed using three colors, namely cyan, magenta, and yellow. Color printing may be performed by adding at least one color from light cyan, light magenta, light yellow, orange, green, gray, and the like to the three colors, namely cyan, magenta, and yellow. Each ink may contain a preservative.

White ink can be used as underlayer printing before color printing when the medium M is a transparent or semi-transparent film and when the color of the medium M is a dark color. The underlayer printing is also called solid printing or painting-out printing.

The liquid ejecting apparatus 11 includes a control portion 23 configured to control various operations executed by the liquid ejecting apparatus 11. The control portion 23 is configured of a processing circuit or the like including a computer and a memory, for example, and controls various mechanisms included in the liquid ejecting apparatus 11, such as the transport portion 15 and the operation panel 18, in accordance with a program stored in the memory.

Figure 2:
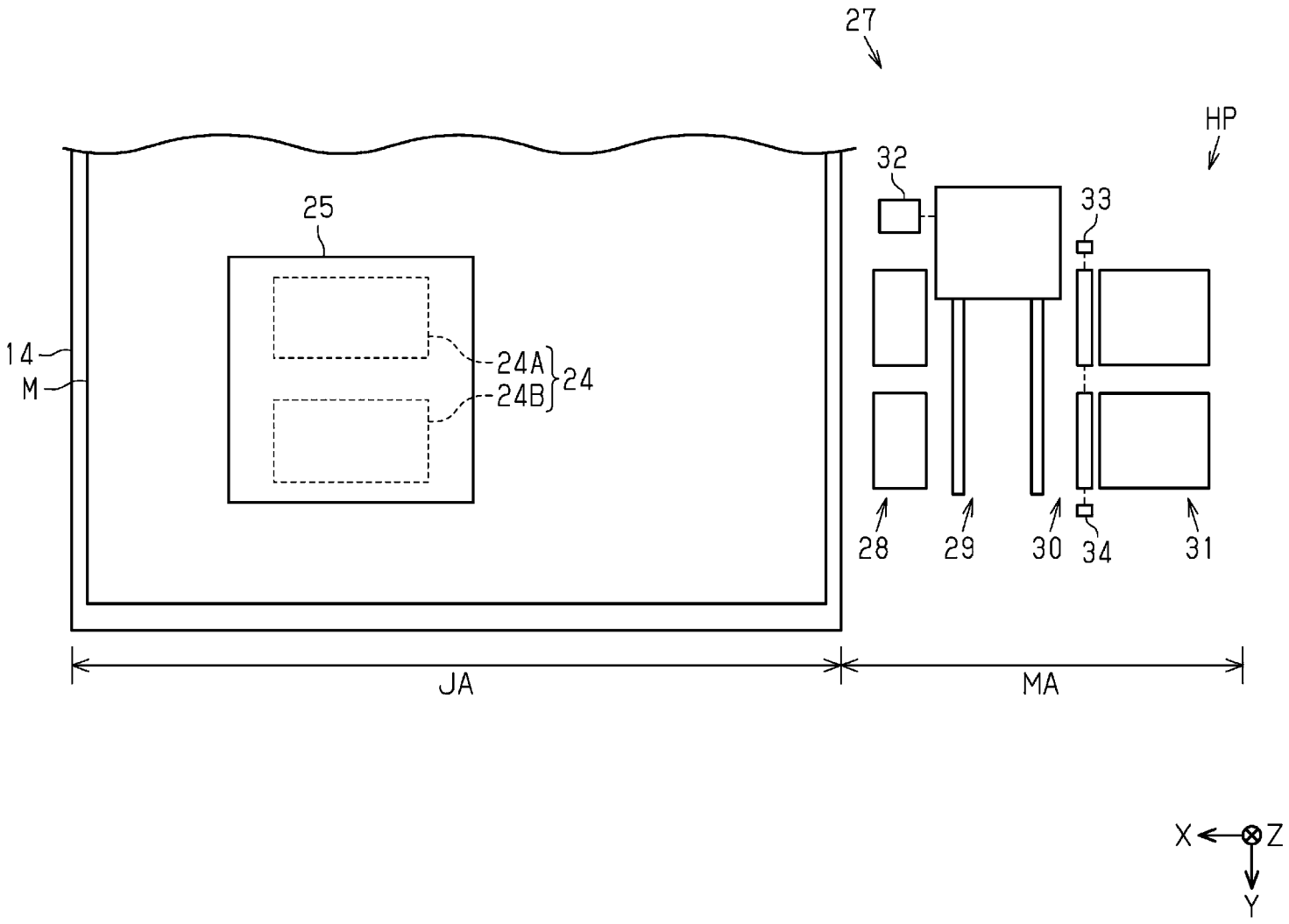
FIG. 2 is a schematic plan view illustrating an inner configuration of the liquid ejecting apparatus.

As illustrated in FIG. 2, the liquid ejecting apparatus 11 includes a liquid ejecting portion 24 configured to eject a liquid supplied from the liquid supply sources 21 and a carriage 25 on which the liquid ejecting portion 24 is mounted. The liquid ejecting portion 24 has a first liquid ejecting head 24A and a second liquid ejecting head 24B aligned in the transport direction Y. The second liquid ejecting head 24B is located further downstream in the transport direction Y than the first liquid ejecting head 24A.

The liquid ejecting apparatus 11 has a maintenance region MA and an ejecting region JA that are adjacent to each other in the scanning direction X. The ejecting region JA is a region in which the liquid ejecting portion 24 ejects the liquid to perform printing on the medium M. In the embodiment, the width of the ejecting region JA in the scanning direction X conforms to the width of the placement portion 14.

The liquid ejecting apparatus 11 includes a maintenance unit 27 provided in the maintenance region MA. The maintenance unit 27 includes a liquid collecting mechanism 28, a wiping mechanism 29, a suctioning mechanism 30, and a capping mechanism 31 in an order from the one disposed at a position closest to the ejecting region JA. A position above the capping mechanism 31 is a home position HP of the liquid ejecting portion 24. The home position HP is a start point of movement of the liquid ejecting portion 24.

The maintenance unit 27 includes a wiping solution supply mechanism 32 configured to supply a wiping solution to the wiping mechanism 29, a cleaning solution supply mechanism 33 configured to supply a cleaning solution to the suctioning mechanism 30, and a discharge mechanism 34 configured to discharge a liquid in the suctioning mechanism 30.

When the liquid ejected by the liquid ejecting portion 24 is a water-based ink, the cleaning solution may be pure water or may be water to which additives such as a preservative, a surfactant, and a humidifier are added. When the liquid ejected by the liquid ejecting portion 24 is a solvent ink, the cleaning solution may be a solvent.

Figure 3:
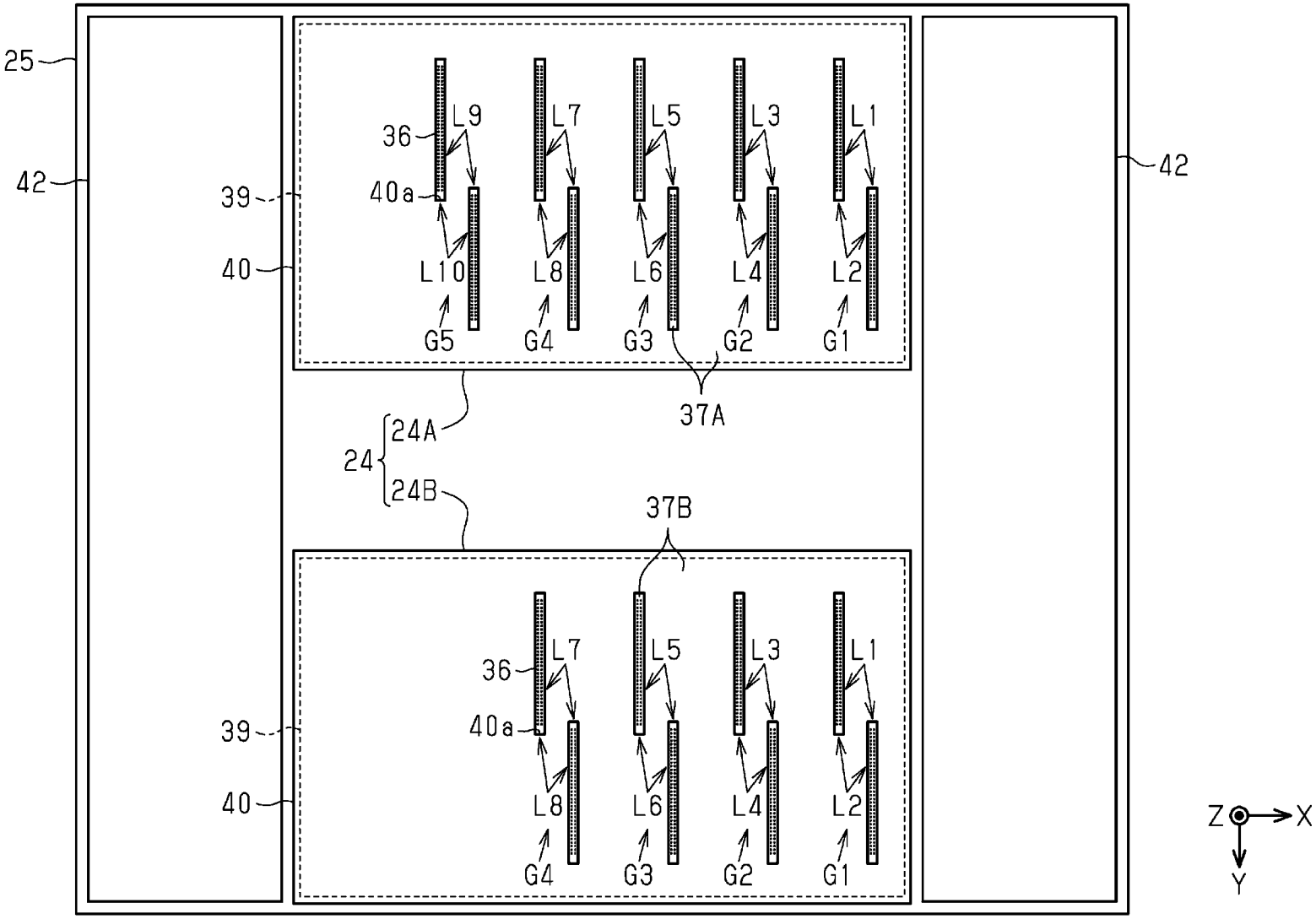
FIG. 3 is a schematic bottom view illustrating a liquid ejecting portion and a carriage.

As illustrated in FIG. 3, the first liquid ejecting head 24A has a first nozzle surface 37A in which nozzles 36 configured to eject a liquid are disposed. The second liquid ejecting head 24B has a second nozzle surface 37B in which nozzles 36 configured to eject a liquid are disposed. The first nozzle surface 37A and the second nozzle surface 37B are provided at an interval in the transport direction Y. The first nozzle surface 37A is located further upstream in the transport direction Y than the second nozzle surface 37B.

A plurality of nozzles 36 configured to eject a first liquid may be provided in the first nozzle surface 37A such that the nozzles 36 are aligned and form nozzle arrays in the transport direction Y. A plurality of nozzles 36 configured to eject a second liquid may be provided in the second nozzle surface 37B such that the nozzles 36 are aligned and form nozzle arrays in the transport direction Y. In other words, the liquid ejected from the nozzles 36 included in the first nozzle surface 37A may be the first liquid. The liquid ejected from the nozzles 36 included in the second nozzle surface 37B may be the second liquid. In the embodiment, the first liquid is a white ink, and the second liquid is a color ink. The first liquid may contain a component with higher hardness than that of a component contained in the second liquid.

Although the first liquid ejecting head 24A and the second liquid ejecting head 24B have different numbers of nozzles 36 in different disposition, configurations thereof are substantially the same. Therefore, the first liquid ejecting head 24A will be describe below, the same reference signs as those of the first liquid ejecting head 24A will be applied to the configuration of the second liquid ejecting head 24B, and repeated description will be omitted.

The first liquid ejecting head 24A may include a nozzle forming member 39 at which the plurality of nozzles 36 are formed and a cover member 40 that covers a part of the nozzle forming member 39. The cover member 40 is made of metal such as stainless steel, for example. A plurality of through-holes 40*a* that penetrate through the cover member 40 in the ejecting direction Z are formed in the cover member 40. The cover member 40 covers a side of the nozzle forming member 39, on which the nozzles 36 are formed, such that the nozzles 36 are exposed from the through-holes 40*a*. The first nozzle surface 37A is formed to include the nozzle forming member 39 and the cover member 40. Specifically, the first nozzle surface 37A is configured of the nozzle forming member 39 exposed from the through-holes 40*a* and the cover member 40.

Multiple openings of the nozzles 36 configured to eject the liquid are aligned at constant intervals in a direction in the first liquid ejecting head 24A. The plurality of nozzles 36 configure nozzle arrays. In the embodiment, the openings of the nozzles 36 are aligned in the transport direction Y and configure a first nozzle array L1 to tenth nozzle array L10. A nozzle 36 located upstream in the transport direction Y and a nozzle 36 located downstream in the transport direction Y among the nozzles 36 configuring one nozzle array are formed at positions that are deviated from each other in the scanning direction X.

The first nozzle array L1 to the tenth nozzle array L10 are aligned such that every two arrays are located close to each other in the scanning direction X. In the embodiment, two nozzle arrays that are aligned close to each other will be referred to as a nozzle group. A first nozzle group G1 to a fifth nozzle group G5 are disposed at constant intervals in the scanning direction X in the first liquid ejecting head 24A.

Specifically, the first nozzle group G1 includes the first nozzle array L1 and the second nozzle array L2. The second nozzle group G2 includes the third nozzle array L3 and the fourth nozzle array L4. The third nozzle group G3 includes the fifth nozzle array L5 and the sixth nozzle array L6. The fourth nozzle group G4 includes the seventh nozzle array L7 and the eighth nozzle array L8. The fifth nozzle group G5 includes the ninth nozzle array L9 and the tenth nozzle array L10. In the first liquid ejecting head 24A according to the embodiment, all the nozzles 36 eject a white ink.

The nozzles 36 formed in the second liquid ejecting head 24B configures a first nozzle array L1 to an eighth nozzle arrays L8. Nozzles 36 that configure one nozzle array among the nozzles 36 formed in the second liquid ejecting head 24B eject the same type of liquid. Specifically, a first nozzle group G1 includes the first nozzle array L1 configured to eject a cyan ink and the second nozzle array L2 configured to eject a magenta ink. A second nozzle group G2 includes the third nozzle array L3 configured to eject a yellow ink and the fourth nozzle array L4 configured to eject a black ink. A third nozzle group G3 includes the fifth nozzle array L5 configured to eject a black ink and the sixth nozzle array L6 configured to eject a yellow ink. A fourth nozzle group G4 includes the seventh nozzle array L7 configured to eject a magenta ink and an eighth nozzle array L8 configured to eject a cyan ink.

The liquid ejecting apparatus 11 may include a rectification portion 42 held below the carriage 25. When rectification portions 42 are provided on both sides of the liquid ejecting portion 24 in the scanning direction X, it is possible to easily organize an air flow in the periphery of the liquid ejecting portion 24 that reciprocates in the scanning direction X and in the direction that is opposite to the scanning direction X.

Figure 4:
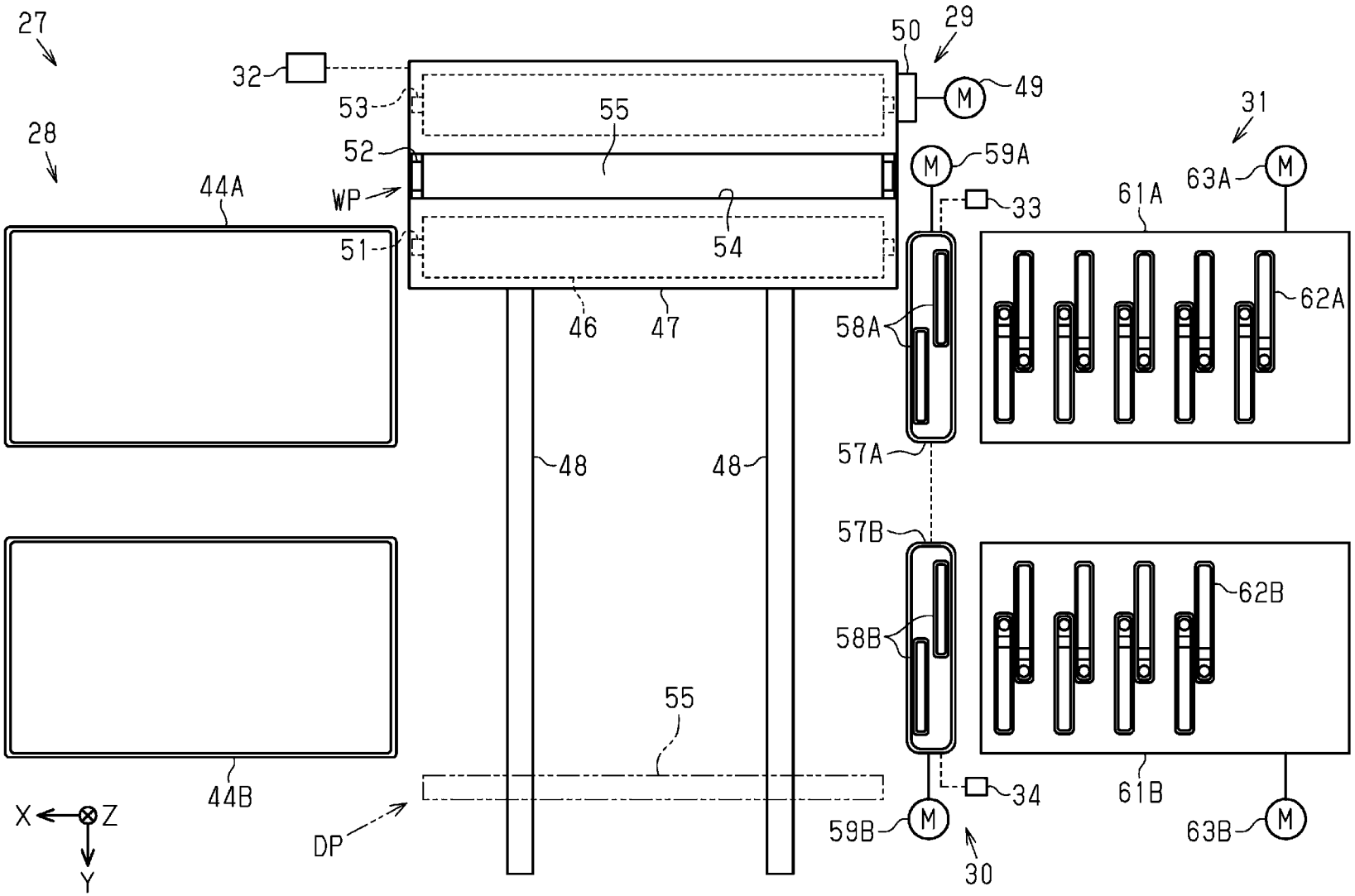
FIG. 4 is a schematic plan view of a maintenance unit.

As illustrated in FIG. 4, the liquid collecting mechanism 28 collects the liquid discharged from the first liquid ejecting head 24A and the second liquid ejecting head 24B through flashing. Flashing is maintenance in which the liquid is ejected as a waste liquid for the purpose of preventing and solving clogging of the nozzles 36.

The liquid collecting mechanism 28 includes a first liquid receiving portion 44A and a second liquid receiving portion 44B aligned in the transport direction Y. The first liquid receiving portion 44A collects the liquid discharged from the nozzles 36 that are opened in the first nozzle surface 37A for the purpose of maintenance of the first liquid ejecting head 24A. The Second liquid receiving portion 44B collects the liquid discharged from the nozzles 36 that are opened in the second nozzle surface 37B for the purpose of maintenance of the second liquid ejecting head 24B.

The wiping mechanism 29 has a strip-shaped member 46 with a sheet shape configured to wipe the first liquid ejecting head 24A and the second liquid ejecting head 24B, a case 47 configured to accommodate the strip-shaped member 46, a pair of rails 48 extending in the transport direction Y, and a wiping motor 49 configured to cause the case 47 to move. The case 47 is provided with a power transmission mechanism 50 configured to transmit power of the wiping motor 49. The power transmission mechanism 50 is configured of a rack and pinion mechanism, for example. The case 47 reciprocates along the rails 48 using the power of the wiping motor 49.

The wiping mechanism 29 may include a feeding shaft 51 configured to feed the strip-shaped member 46, a pressing roller 52 configured to press upward the strip-shaped member 46, and a winding shaft 53 configured to wind the strip-shaped member 46 after use. The case 47 rotatably supports the feeding shaft 51, the pressing roller 52, and the winding shaft 53. An opening 54 configured to cause the strip-shaped member 46 wound around the pressing roller 52 to be exposed is formed in the case 47.

The wiping mechanism 29 has a wiping portion 55 capable of wiping the first nozzle surface 37A and the second nozzle surface 37B. The wiping portion 55 is a part of the strip-shaped member 46 included in the wiping mechanism 29, which is brought into contact with either the first nozzle surface 37A or the second nozzle surface 37B. The wiping portion 55 in the embodiment is a part of the strip-shaped member 46 that is pressed upward by the pressing roller 52 and that projects from the opening 54.

The strip-shaped member 46 has absorbability with which a liquid and the like are absorbed. Therefore, the strip-shaped member 46 is configured to be able to absorb the liquid used by the liquid ejecting portion 24 and the wiping solution supplied by the wiping solution supply mechanism 32.

The wiping portion 55 positioned at a standby position WP illustrated in FIG. 4 moves in the transport direction Y and reaches a downstream position DP illustrated by the two-dotted dashed line in FIG. 4 by the wiping motor 49 rotating forward and the case 47 moving. The wiping portion 55 located at the downstream position DP moves in the direction that is opposite to the transport direction Y and returns to the standby position WP by the wiping motor 49 being driven backward. The standby position WP of the wiping portion 55 is located further upstream in the transport direction Y than the first nozzle surface 37A. The downstream position DP of the wiping portion 55 is located further downstream in the transport direction Y than the second nozzle surface 37B.

The wiping portion 55 may wipe the liquid ejecting portion 24 in at least either a process of moving in the transport direction Y or a process of moving in the direction that is opposite to the transport direction Y. Wiping is maintenance in which at least either the first nozzle surface 37A or the second nozzle surface 37B is wiped using the wiping portion 55.

In the embodiment, the direction in which the wiping portion 55 moves to perform wiping will be referred to as a wiping direction. The wiping mechanism 29 is configured such that the wiping portion 55 moves in the wiping direction and performs wiping. In other words, the transport direction Y is the wiping direction when the wiping portion 55 that moves in the transport direction Y performs wiping. When the wiping portion 55 that moves in the direction that is opposite to the transport direction Y performs wiping, the direction that is opposite to the transport direction Y is the wiping direction.

The wiping direction is a direction, in which the first nozzle surface 37A and the second nozzle surface 37B are aligned, which is parallel to the transport direction Y of the transported medium M and is different from the scanning direction X. In other words, the wiping direction is a direction along the transport direction Y in which the medium M is transported and is a direction that intersects the scanning direction X. The first nozzle surface 37A is located between the standby position WP and the second nozzle surface 37B in the wiping direction and is sandwiched between the standby position WP and the second nozzle surface 37B. The second nozzle surface 37B is located between the first nozzle surface 37A and the downstream position DP in the wiping direction and is sandwiched between the first nozzle surface 37A and the downstream position DP.

The wiping mechanism 29 brings the strip-shaped member 46 into contact with the first nozzle surface 37A and wipes the first nozzle surface 37A such that the pressing roller 52 presses the strip-shaped member 46 against the first nozzle surface 37A. In other words, the wiping mechanism 29 wipes the first nozzle surface 37A by the case 47 moving in a state in which the strip-shaped member 46 is sandwiched between the pressing roller 52 and the first nozzle surface 37A. The wiping mechanism 29 also wipes the second nozzle surface 37B similarly to the first nozzle surface 37A.

The width of the strip-shaped member 46 in the scanning direction X may be larger than the size of the region in which the nozzle 36 is formed. In other words, the width of the strip-shaped member 46 may be equal to or greater than the width from the nozzle 36 that is included in the first nozzle array L1 and is located downstream in the transport direction Y to the nozzle 36 that is included in the tenth nozzle array L10 and is located upstream in the transport direction Y. The width of the strip-shaped member 46 in the embodiment is equal to or greater than the width of the cover member 40, which is the width of the first nozzle surface 37A and the second nozzle surface 37B, in the scanning direction X.

The wiping mechanism 29 may hold the strip-shaped member 46 such that the portion of the strip-shaped member 46 that serves as the wiping portion 55 can be changed. For example, the power transmission mechanism 50 may disconnect the wiping motor 49 from the winding shaft 53 when the wiping motor 49 rotates forward and may couple the wiping motor 49 to the winding shaft 53 when the wiping motor 49 rotates backward. The winding shaft 53 may rotate using a power with which the wiping motor 49 rotates backward. The winding shaft 53 may wind the strip-shaped member 46 when the case 47 moves from the downstream position DP to the standby position WP.

As illustrated in FIG. 4, the suctioning mechanism 30 may include a first tub 57A and a second tub 57B aligned in the transport direction Y, a first suctioning cap 58A provided in the first tub 57A, a second suctioning cap 58B provided in the second tub 57B. The suctioning mechanism 30 may include a first suctioning motor 59A that causes the first suctioning cap 58A to reciprocate along the Z axis and a second suctioning motor 59B that causes the second suctioning cap 58B to reciprocate along the Z axis.

The cleaning solution supply mechanism 33 supplies the cleaning solution to the inside of the first suctioning cap 58A and the second suctioning cap 58B. The discharge mechanism 34 discharges the liquid inside the first suctioning cap 58A and the second suctioning cap 58B.

The first suctioning cap 58A may be configured to collectively surround al the nozzles 36 included in the first liquid ejecting head 24A, may be configured to surround at least one nozzle group, or may be configured to surround some of the nozzles 36 included in a nozzle group. The second suctioning cap 58B may be configured to surround all the nozzles 36 included in the second liquid ejecting head 24B, may be configured to surround at least one nozzle group, or may be configured to surround some of the nozzles 36 included in a nozzle group. The suctioning mechanism 30 according to the embodiment separately caps the nozzle 36 located upstream in the transport direction Y and the nozzle 36 located downstream in the transport direction Y among the nozzles 36 that forms one nozzle group.

The first suctioning motor 59A causes the first suctioning cap 58A and the first tub 57A to move between a suctioning position and a retreating position. The second suctioning motor 59B causes the second suctioning cap 58B and the second tub 57B to move between a suctioning position and a retreating position. The suctioning position is a position at which the first suctioning cap 58A is brought into contact with the first liquid ejecting head 24A and the second suctioning cap 58B is brought into contact with the second liquid ejecting head 24B. The retreating position is a position at which the first suctioning cap 58A and the second suctioning cap 58B are separated from the liquid ejecting portion 24.

As illustrated in FIG. 4 the capping mechanism 31 may include a first leaving holding body 61A and a second leaving holding body 61B aligned in the transport direction Y. The capping mechanism 31 may include a first leaving cap 62A held by the first leaving holding body 61A and a first leaving motor 63A that causes the first leaving holding body 61A to move. The capping mechanism 31 may include a second leaving cap 62B held by the second leaving holding body 61B and a second leaving motor 63B that causes the second leaving holding body 61B to move.

The first leaving cap 62A is driven by the first leaving motor 63A to be lifted from an isolation position, move to a capping position, and be brought into contact with the first nozzle surface 37A of the first liquid ejecting head 24A stopping at the home position HP. The first leaving cap 62A located at the capping position surrounds the openings of the nozzles 36 included in the first nozzle group G1 to the fifth nozzle group G5 provided in the first nozzle surface 37A.

The second leaving cap 62B is driven by the second leaving motor 63B to be lifted from an isolation position, move to a capping position, and be brought into contact with the second nozzle surface 37B of the second liquid ejecting head 24B stopping at the home position HP. The second leaving cap 62B located at the capping position surrounds the openings of the nozzles 36 included in the first nozzle group G1 to the fourth nozzle group G4 provided in the second nozzle surface 37B.

In this manner, maintenance in which the first leaving cap 62A and the second leaving cap 62B surround the openings of the nozzles 36 is referred to as leaving capping. The leaving capping is a type of capping. The leaving capping curbs drying of the nozzles 36.

The first leaving cap 62A may be configured to collectively surround all the nozzles 36 in the first nozzle surface 37A, may be configured to surround at least one nozzle group, or may be configured to surround some of the nozzles 36 included in a nozzle group.

The second leaving cap 62B may be configured to collectively surround all the nozzles 36 in the second nozzle surface 37B, may be configured to surround at least one nozzle group, or may be configured to surround some of the nozzles 36 included in a nozzle group.

The capping mechanism 31 according to the embodiment has 10 first leaving caps 62A and eight second leaving caps 62B. One of the first leaving caps 62A or one of the second leaving caps 62B corresponds to the nozzle 36 located upstream in the transport direction Y or the nozzle 36 located downstream in the transport direction Y among the nozzles 36 included in one nozzle group. The first leaving cap 62A and the second leaving cap 62B have different disposition directions between the one located upstream in the transport direction Y and the one located downstream in the transport direction Y while the configurations thereof are the same.

Figure 5:
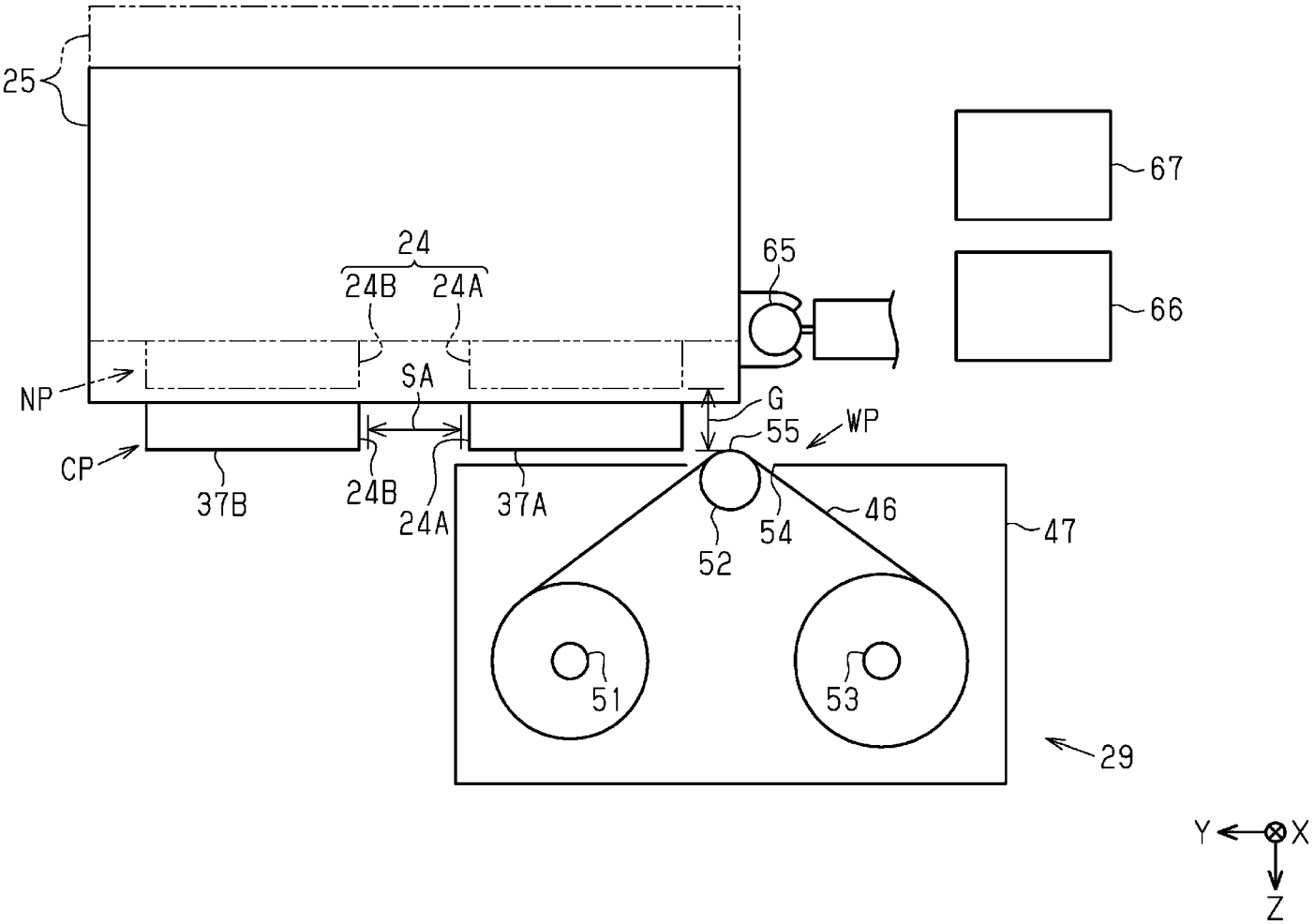
FIG. 5 is a schematic side view of a wiping portion positioned at a standby position.

As illustrated in FIG. 5, the liquid ejecting apparatus 11 may include a guide shaft 65 configured to support the carriage 25 and a liquid ejecting portion moving mechanism 66 configured to cause the liquid ejecting portion 24 to move in the scanning direction X. The guide shaft 65 extends in the scanning direction X. The liquid ejecting portion moving mechanism 66 causes the carriage 25 to reciprocate along the guide shaft 65. The liquid ejecting portion 24 may move in a maintenance region MA in which the wiping mechanism 29 is disposed and an ejecting region JA in which the nozzles 36 eject the liquid onto the medium M.

An interval of the first nozzle surface 37A, the second nozzle surface 37B, and the wiping portion 55 in the ejecting direction Z in which the liquid is ejected from the nozzles 36 will be referred to as a gap G. The liquid ejecting apparatus 11 may include a gap changing mechanism 67 capable of changing the gap G.

The gap changing mechanism 67 changes the gap G between a contact interval at which the first nozzle surface 37A and the second nozzle surface 37B can be wiped and a non-contact interval at which the first nozzle surface 37A and the second nozzle surface 37B are not brought into contact with the wiping portion 55.

The gap changing mechanism 67 may move the liquid ejecting portion 24 and change the gap G between the contact interval and the non-contact interval. Specifically, the gap G is the non-contact interval in the state in which the liquid ejecting portion 24 and the carriage 25 are located at the non-contact position NP as illustrated by the two-dotted dashed line in FIG. 5. As illustrated by the solid line in FIG. 5, the gap G is the contact interval in the state in which the liquid ejecting portion 24 and the carriage 25 are located at the contact position CP.

The gap changing mechanism 67 causes the liquid ejecting portion 24 located at the non-contact position NP to move in the ejecting direction Z and changes the gap G to the contact interval. The gap changing mechanism 67 causes the liquid ejecting portion 24 located at the contact position CP to move in the direction opposite to the ejecting direction Z and changes the gap G to the non-contact interval.

Figure 6:
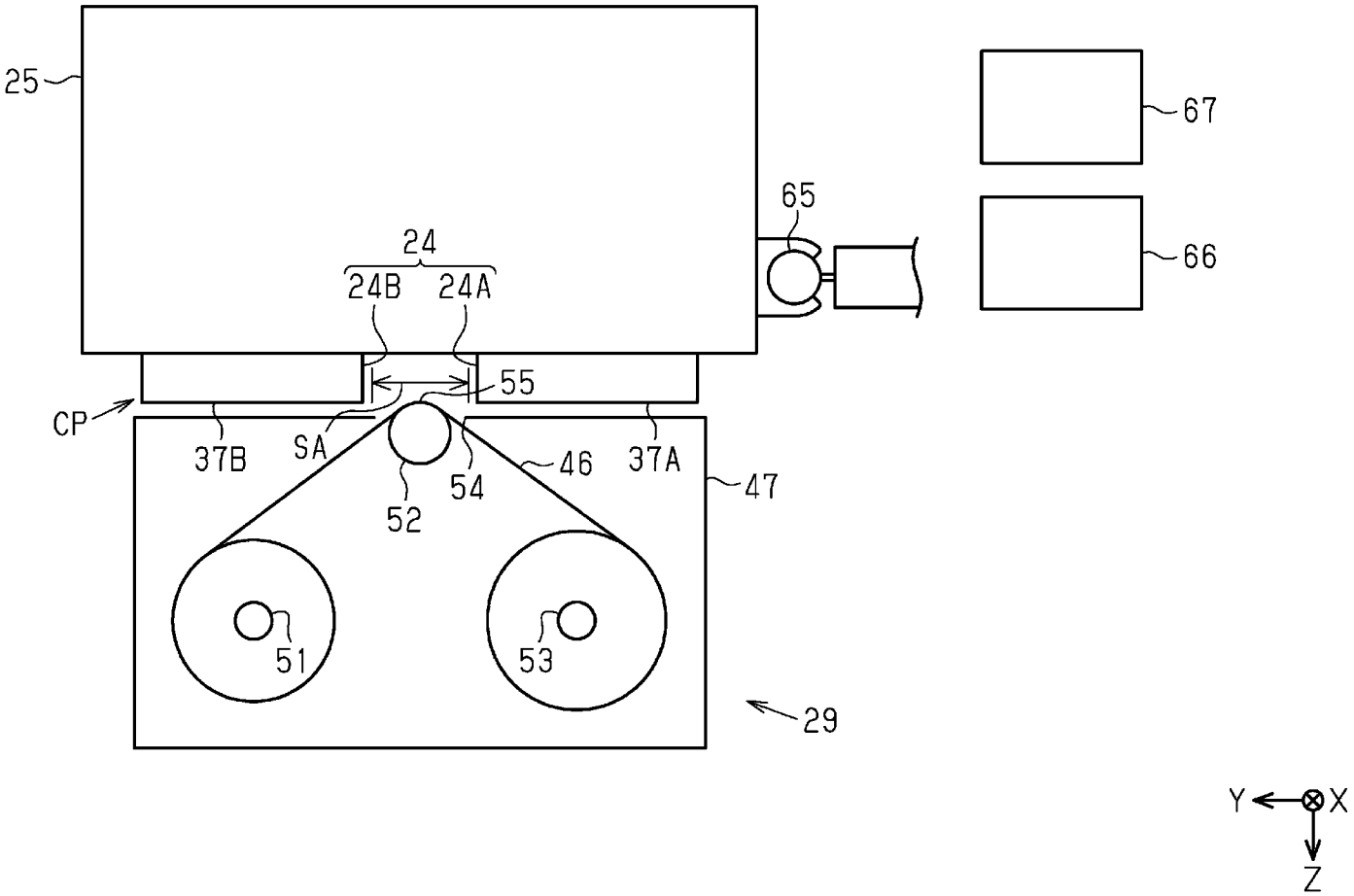
FIG. 6 is a schematic side view of the wiping portion positioned in an isolation region.

As illustrated in FIG. 6, the interval between the first nozzle surface 37A and the second nozzle surface 37B in the wiping direction is greater than the size of the wiping portion 55. Therefore, isolation region SA in which the wiping portion 55 is not brought into contact with the first nozzle surface 37A and the second nozzle surface 37B when the gap G is the contact interval is provided between the first nozzle surface 37A and the second nozzle surface 37B in the wiping direction.

The isolation region SA may be provided such that the liquid ejecting portion 24 can move in the scanning direction X and in the direction that is opposite to the scanning direction X in the maintenance region MA and the ejecting region JA in the state in which the gap G is the contact interval and the wiping portion 55 is located in the isolation region SA.

Effects of the embodiment will be described. First, a case in which the wiping portion 55 wipes the first nozzle surface 37A and does not wipe the second nozzle surface 37B will be described.

Figure 7:
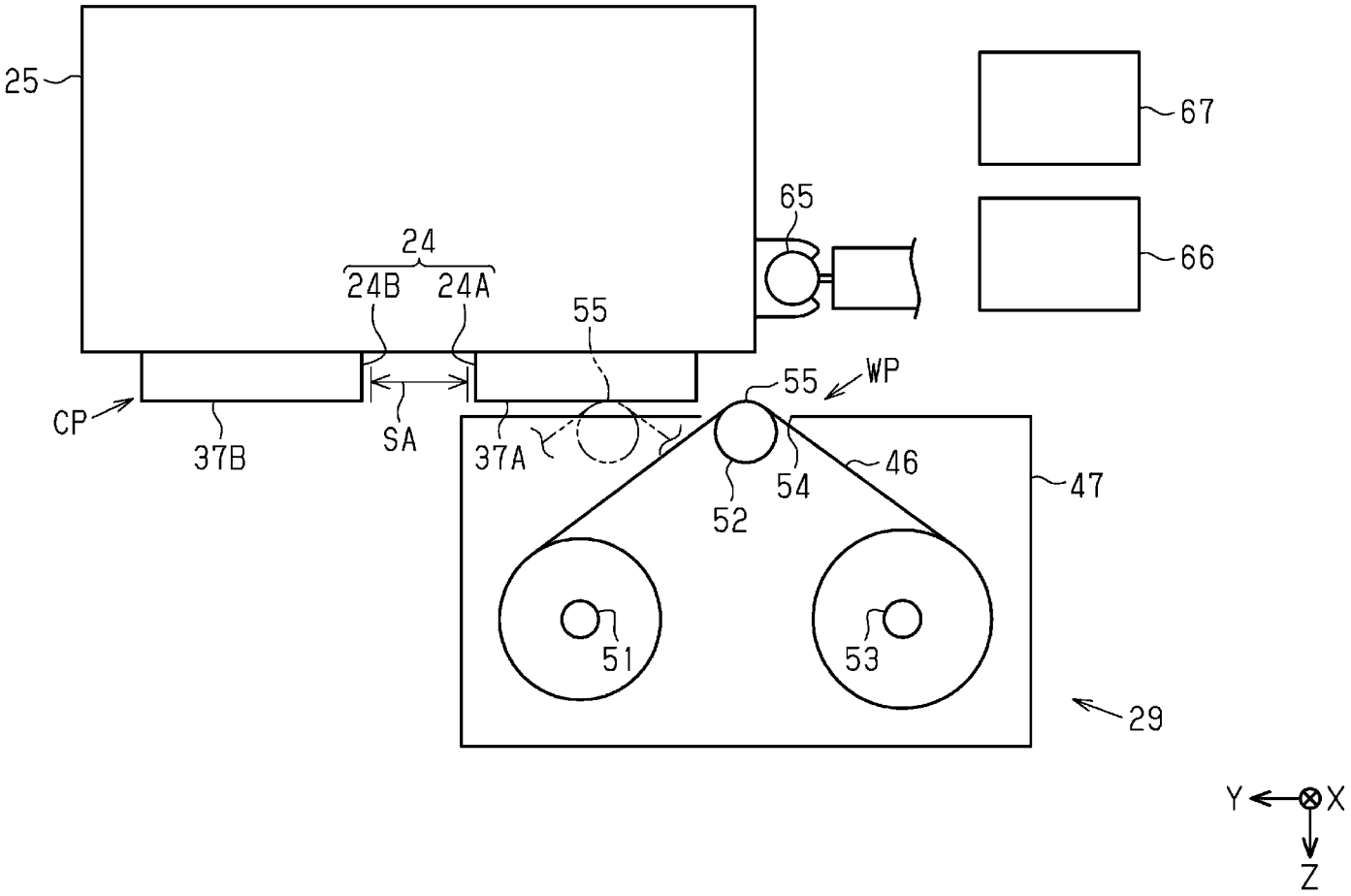
FIG. 7 is a schematic side view of the wiping portion configured to wipe a first nozzle surface.

As illustrated in FIG. 7, the wiping portion 55 is located at the standby position WP, and the liquid ejecting portion 24 is located at the contact position CP such that the gap G is the contact interval, in an initial state. The control portion 23 may drive the wiping solution supply mechanism 32 and supply the wiping solution to the wiping portion 55 before wiping the first nozzle surface 37A. Thereafter, the control portion 23 drives the wiping motor 49 forward and causes the wiping portion 55 to move from the standby position WP toward the second nozzle surface 37B. At this time, the control portion 23 leaves the gap G at the contact interval. In other words, the wiping portion 55 passes through the first nozzle surface 37A at the contact interval and wipes the first nozzle surface 37A.

Figure 8:
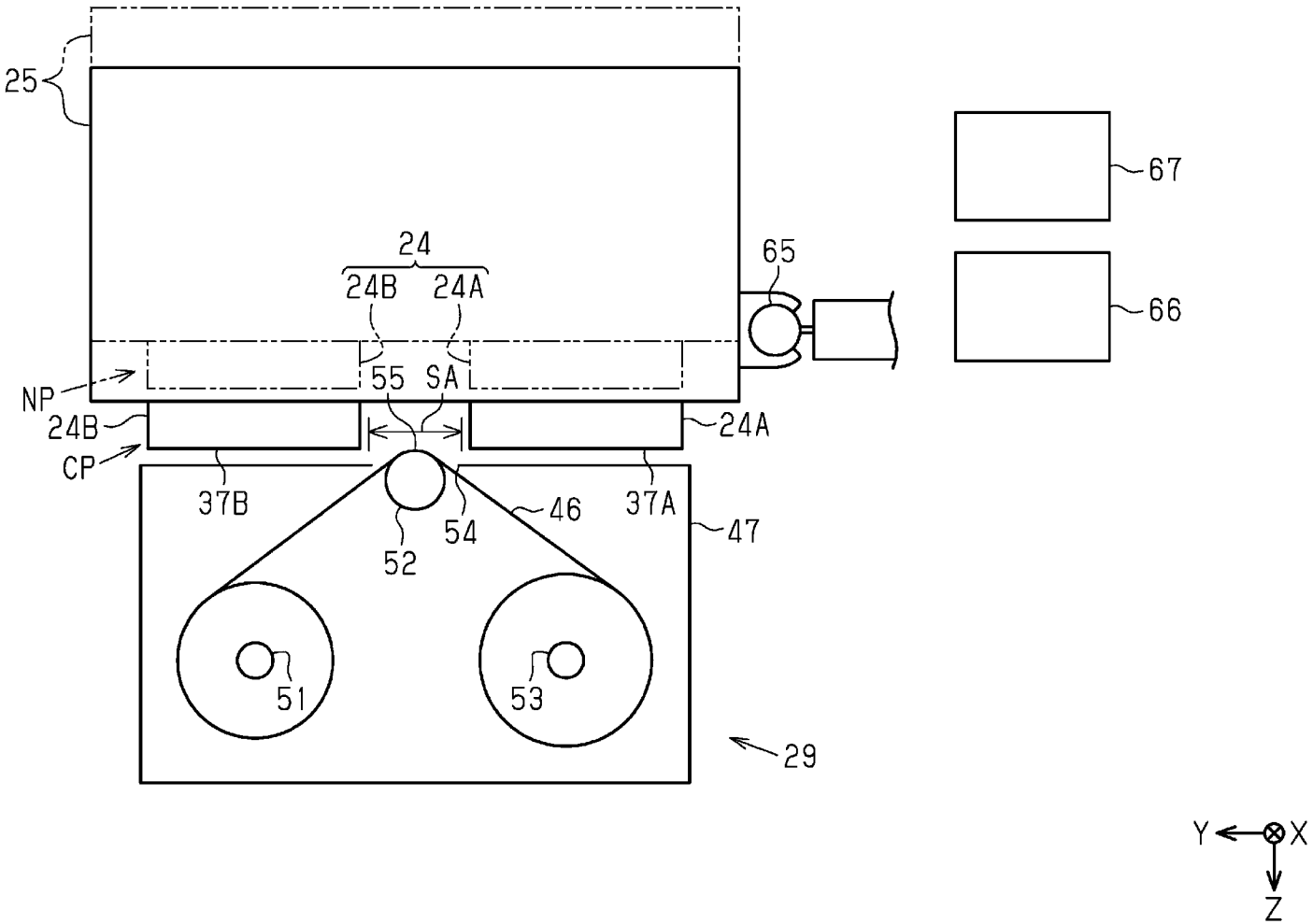
FIG. 8 is a schematic side view of the wiping portion positioned in the isolation region.

As illustrated in FIG. 8, when the wiping portion 55 moves up to the isolation region SA, then the control portion 23 stops driving of the wiping motor 49. Thereafter, the control portion 23 drives the gap changing mechanism 67 in the state in which the wiping portion 55 is located in the isolation region SA. The control portion 23 causes the liquid ejecting portion 24 located at the contact position CP to move in the direction opposite to the ejecting direction Z as illustrated by the solid line in FIG. 8. The control portion 23 causes the liquid ejecting portion 24 to move to the non-contact position NP as illustrated by the two-dotted dashed line in FIG. 8 and changes the gap G to the non-contact interval. In other words, the control portion 23 changes the gap G to the non-contact interval in the state in which the wiping portion 55 is located in the isolation region SA.

Figure 9:
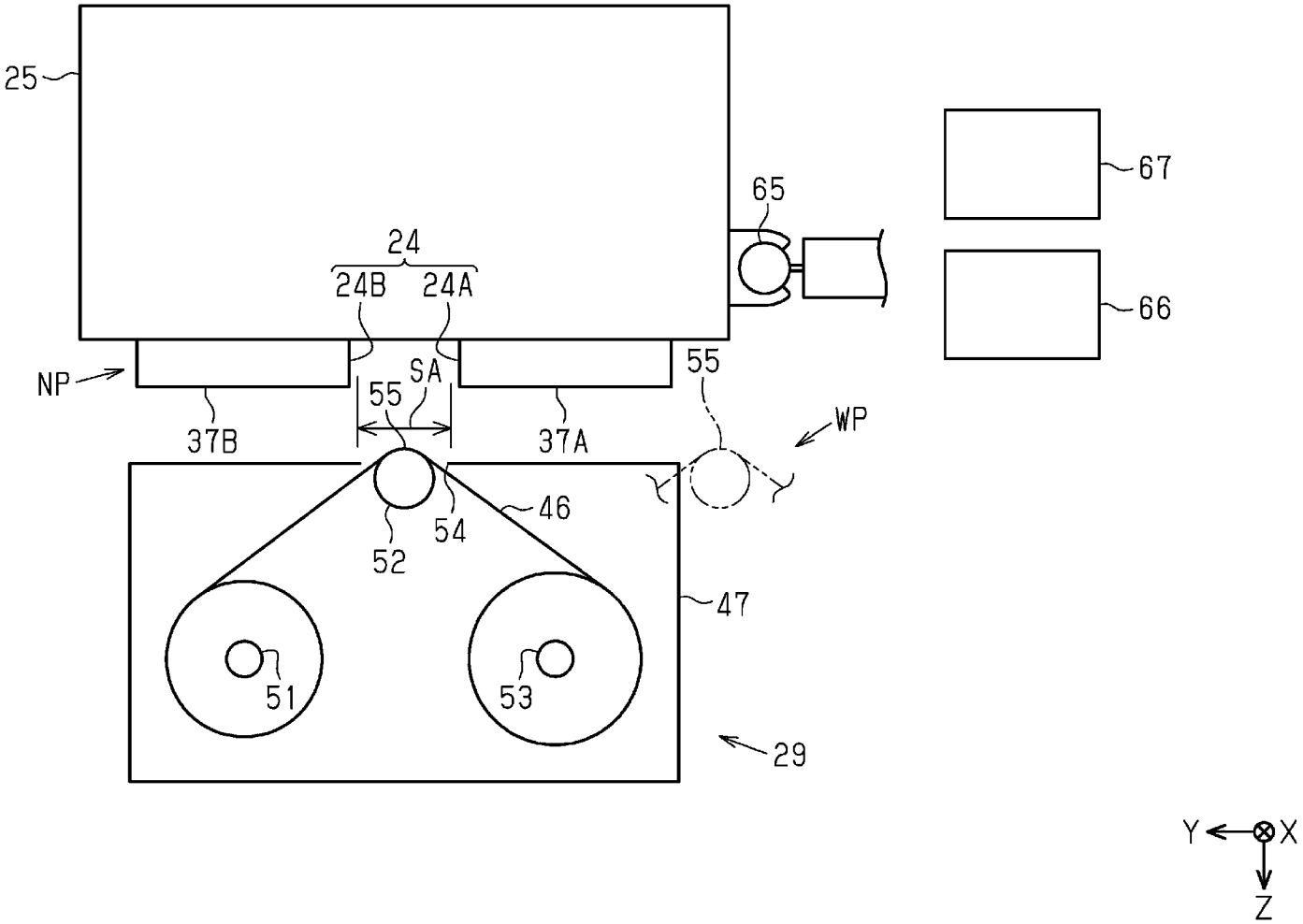
FIG. 9 is a schematic side view of the wiping portion that moves from the isolation region to the standby position at a non-contact interval.

As illustrated in FIG. 9, the control portion 23 drives the wiping motor 49 backward and causes the wiping portion 55 located in the isolation region SA to move toward the standby position WP. At this time, since the liquid ejecting portion 24 sets the gap G to the non-contact interval, the wiping portion 55 returns to the standby position WP without being brought into contact with the first nozzle surface 37A.

Next, a case in which the wiping portion 55 wipes the second nozzle surface 37B without wiping the first nozzle surface 37A will be described. As illustrated in FIG. 5, the wiping portion 55 and the liquid ejecting portion 24 are assumed to be in an initial state. The control portion 23 drives the gap changing mechanism 67, causes the liquid ejecting portion 24 located at the contact position CP as illustrated by the solid line in FIG. 5 to move in the direction opposite to the ejecting direction Z and causes the liquid ejecting portion 24 to move to the non-contact position NP as represented by the two-dotted dashed line in FIG. 5.

Figure 10:
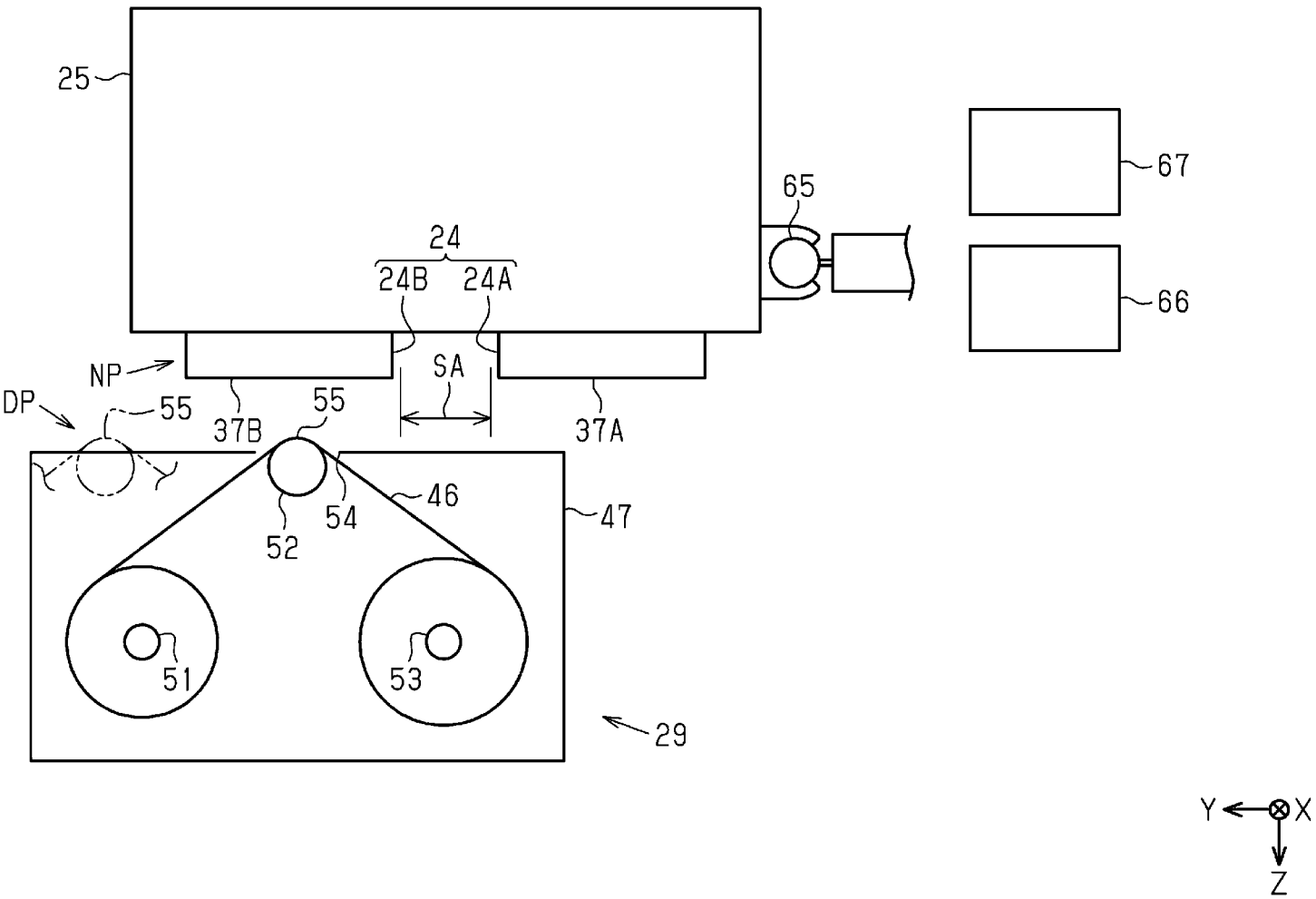
FIG. 10 is a schematic side view of the wiping portion that passes through a second nozzle surface at the non-contact interval.

As illustrated in FIG. 10, the control portion 23 drives the wiping motor 49 forward and causes the wiping portion 55 to move from the standby position WP toward the second nozzle surface 37B. At this time, since the liquid ejecting portion 24 sets the gap G to the non-contact interval, the wiping portion 55 passes through the first nozzle surface 37A without being brought into contact with the first nozzle surface 37A.

Further, the control portion 23 continues to drive the wiping motor 49 forward and causes the wiping portion 55 to move up to the downstream position DP. The wiping portion 55 passes through the second nozzle surface 37B without being brought into contact with the second nozzle surface 37B. In other words, when the second nozzle surface 37B is wiped from the standby position WP, the control portion 23 causes the wiping portion 55 to move from the standby position WP toward the second nozzle surface 37B and causes the wiping portion 55 to pass through the first nozzle surface 37A and the second nozzle surface 37B at the non-contact interval.

Figure 11:
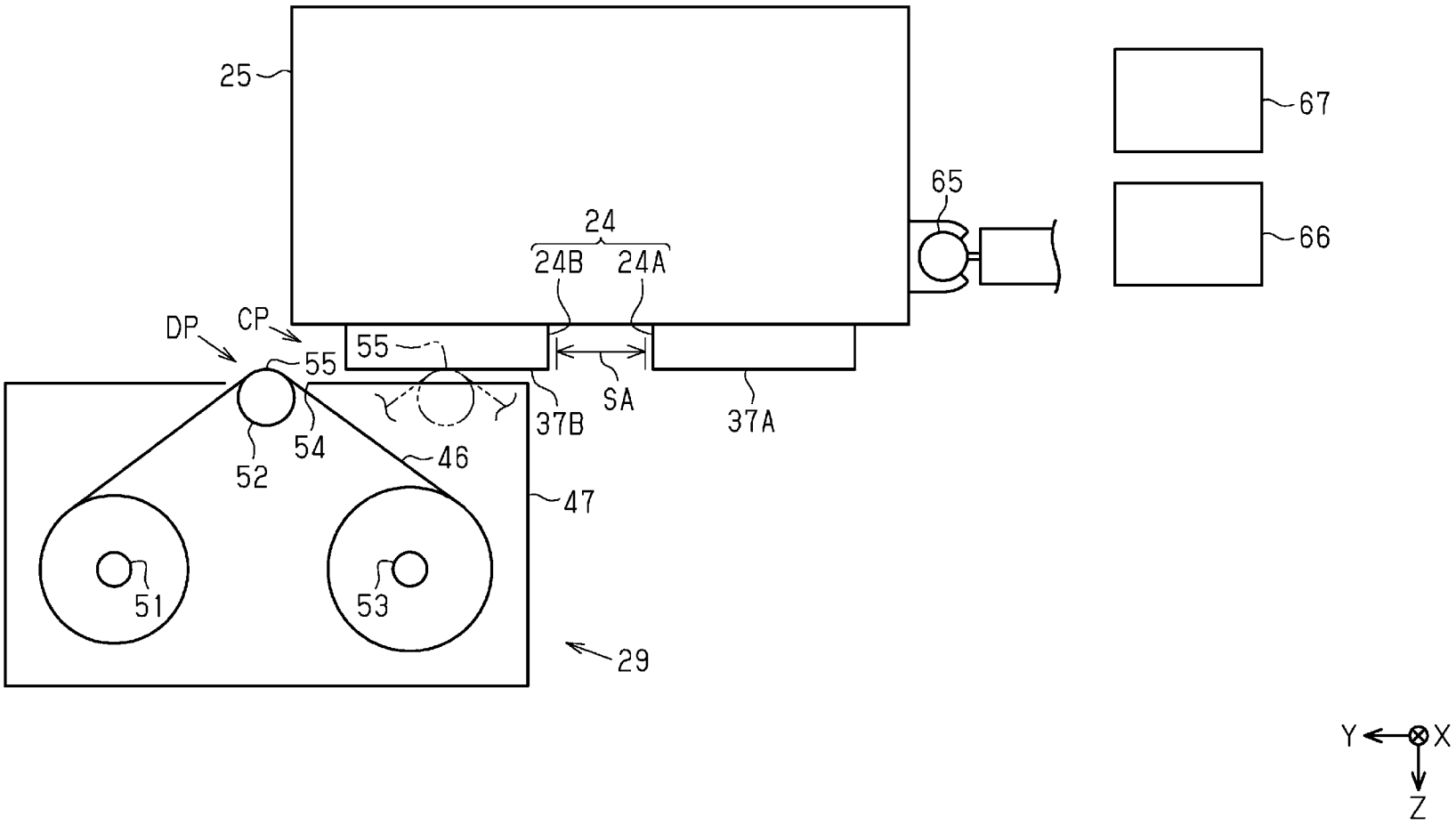
FIG. 11 is a schematic side view of the wiping portion that wipes the second nozzle surface.

If the wiping portion 55 moves up to the downstream position DP as illustrated in FIG. 11, the control portion 23 stops driving of the wiping motor 49. Thereafter, the control portion 23 drives the gap changing mechanism 67 in the state in which the wiping portion 55 is located at the downstream position DP. The control portion 23 causes the liquid ejecting portion 24 to move to the contact position CP. In other words, the control portion 23 changes the gap G to the contact interval in the state in which the wiping portion 55 is located at the downstream position DP.

The control portion 23 drives the wiping motor 49 backward and causes the wiping portion 55 located at the downstream position DP to move toward the first nozzle surface 37A. At this time, the liquid ejecting portion 24 sets the gap G to the contact interval. Therefore, the wiping portion 55 wipes the second nozzle surface 37B. In other words, the control portion 23 causes the wiping portion 55 to move from the standby position WP toward the second nozzle surface 37B, causes the wiping portion 55 to pass through the first nozzle surface 37A at the non-contact interval, then changes the gap to the contact interval, and causes the wiping portion 55 to wipe the second nozzle surface 37B.

As illustrated in FIG. 8, when the wiping portion 55 moves up to the isolation region SA, then the control portion 23 stops driving of the wiping motor 49. Thereafter, the control portion 23 drives the gap changing mechanism 67 in the state in which the wiping portion 55 is located in the isolation region SA. The control portion 23 causes the liquid ejecting portion 24 located at the contact position CP to move in the direction opposite to the ejecting direction Z as illustrated by the solid line in FIG. 8. The control portion 23 causes the liquid ejecting portion 24 to move to the non-contact position NP as illustrated by the two-dotted dashed line in FIG. 8 and changes the gap G to the non-contact interval. In other words, the control portion 23 changes the gap G to the non-contact interval in the state in which the wiping portion 55 is located in the isolation region SA.

As illustrated in FIG. 9, the control portion 23 drives the wiping motor 49 backward and causes the wiping portion 55 located in the isolation region SA to move toward the standby position WP. At this time, since the liquid ejecting portion 24 sets the gap G to the non-contact interval, the wiping portion 55 returns to the standby position WP without being brought into contact with the first nozzle surface 37A.

Next, a case in which the first nozzle surface 37A and the second nozzle surface 37B are wiped from the standby position WP will be described.

As illustrated in FIG. 7, the control portion 23 may drive the wiping solution supply mechanism 32 and supply the wiping solution to the wiping portion 55 before wiping the first nozzle surface 37A. Thereafter, the control portion 23 drives the wiping motor 49 forward and causes the wiping portion 55 to move from the standby position WP toward the second nozzle surface 37B. At this time, the control portion 23 leaves the gap G at the contact interval. In other words, the wiping portion 55 passes through the first nozzle surface 37A at the contact interval and wipes the first nozzle surface 37A.

As illustrated in FIG. 8, when the wiping portion 55 moves up to the isolation region SA, then the control portion 23 stops driving of the wiping motor 49. Thereafter, the control portion 23 sets the gap G to the non-contact interval in the state in which the wiping portion 55 is located in the isolation region SA.

As illustrated in FIG. 10, the control portion 23 drives the wiping motor 49 forward and causes the wiping portion 55 to move toward the downstream position DP. At this time, since the liquid ejecting portion 24 sets the gap G to the non-contact interval, the wiping portion 55 passes through the second nozzle surface 37B without being brought into contact with the second nozzle surface 37B.

When the wiping portion 55 moves up to the downstream position DP as illustrated in FIG. 11, the control portion 23 stops driving of the wiping motor 49. Thereafter, the control portion 23 drives the gap changing mechanism 67 in the state in which the wiping portion 55 is located at the downstream position DP. The control portion 23 causes the liquid ejecting portion 24 to move to the contact position CP. In other words, the control portion 23 changes the gap G to the contact interval in the state in which the wiping portion 55 is located at the downstream position DP.

At this time, the control portion 23 may cause the winding shaft 53 to wind the strip-shaped member 46 therearound and change the portion of the strip-shaped member 46 that serves as the wiping portion 55. The winding shaft 53 in the embodiment winds the strip-shaped member 46 with the backward driving of the wiping motor 49. Therefore, it is possible to change the portion of the strip-shaped member 46 that serves as the wiping portion 55 when the wiping portion 55 moves from the downstream position DP to the second nozzle surface 37B in a case in which the downstream position DP is provided at a position away from the second nozzle surface 37B, for example.

The control portion 23 drives the wiping motor 49 backward and causes the wiping portion 55 located at the downstream position DP to move toward the first nozzle surface 37A. At this time, since the liquid ejecting portion 24 sets the gap G to the contact interval, the wiping portion 55 wipes the second nozzle surface 37B.

As illustrated in FIG. 8, when the wiping portion 55 moves up to the isolation region SA, then the control portion 23 stops driving of the wiping motor 49. Thereafter, the control portion 23 drives the gap changing mechanism 67 in the state in which the wiping portion 55 is located in the isolation region SA. The control portion 23 causes the liquid ejecting portion 24 located at the contact position CP to move in the direction opposite to the ejecting direction Z as illustrated by the solid line in FIG. 8. The control portion 23 causes the liquid ejecting portion 24 to move to the non-contact position NP as illustrated by the two-dotted dashed line in FIG. 8 and changes the gap G to the non-contact interval. In other words, the control portion 23 changes the gap G to the non-contact interval in the state in which the wiping portion 55 is located in the isolation region SA.

As illustrated in FIG. 9, the control portion 23 drives the wiping motor 49 backward and causes the wiping portion 55 located in the isolation region SA to move toward the standby position WP. At this time, since the liquid ejecting portion 24 sets the gap G to the non-contact interval, the wiping portion 55 returns to the standby position WP without being brought into contact with the first nozzle surface 37A.

Advantages of the embodiment will be described.

(1) The isolation region SA is provided between the first nozzle surface 37A and the second nozzle surface 37B in the wiping direction. The wiping portion 55 located in the isolation region SA is not brought into contact with the first nozzle surface 37A and the second nozzle surface 37B even when the gap G is the contact interval. Therefore, it is possible to easily wipe either the first nozzle surface 37A or the second nozzle surface 37B by the gap changing mechanism 67 changing the gap G in the state in which the wiping portion 55 is caused to be located in the isolation region SA.

(2) The wiping may also be performed in the process of printing. The liquid ejecting portion 24 can move in the maintenance region MA and the ejecting region JA in the state in which the gap G is the contact interval and the wiping portion 55 is located in the isolation region SA. When the first nozzle surface 37A is wiped during movement of the wiping portion 55 from the standby position WP to the isolation region SA, for example, the wiping portion 55 is located in the isolation region SA after wiping. Since the liquid ejecting portion 24 can move to the ejecting region JA in the state in which the wiping portion 55 is located in the isolation region SA, it is possible to shorten a time required for wiping as compared with a case in which the wiping portion 55 is returned to the standby position WP and the liquid ejecting portion 24 then moves to the ejecting region JA, for example.

(3) The gap changing mechanism 67 causes the liquid ejecting portion 24 to move in the ejecting direction Z. Therefore, the gap changing mechanism 67 can also cause the liquid ejecting portion 24 to move in accordance with the thickness of the medium M, for example. In other words, it is possible to change the gap G of the first nozzle surface 37A, the second nozzle surface 37B, and the wiping portion 55 using a mechanism configured to adjust the interval of the first nozzle surface 37A, the second nozzle surface 37B, and the medium M.

(4) The liquid may fly and adhere to the periphery of the nozzles 36 when the liquid is ejected from the nozzles 36. The white ink is likely to adhere to the first nozzle surface 37A that includes the nozzles 36 configured to eject the white ink, and the color ink is likely to adhere to the second nozzle surface 37B that includes the nozzles 36 configured to eject the color ink. The wiping solution supply mechanism 32 supplies the wiping solution to the wiping portion 55 before wiping the first nozzle surface 37A. The wiping portion 55 dilutes components of the white ink with the wiping solution and also wipes the first nozzle surface 37A. Therefore, it is possible to achieve a state in which the components of the white ink are unlikely to rub the first nozzle surface 37A. Therefore, it is possible to reduce the concern that performance of the first nozzle surface 37A is degraded due to wiping when surface treatment such as liquid-repellent treatment is performed on the first nozzle surface 37A, for example.

(5) A part of the strip-shaped member 46 configures the wiping portion 55. The portion of the strip-shaped member 46 that serves as the wiping portion 55 can be changed. Therefore, it is possible to reduce the concern that performance of the first nozzle surface 37A and the second nozzle surface 37B is degraded due to wiping as compared with a case in which the same portion is repeatedly used to perform wiping.

(6) After the wiping portion 55 moving from the standby position WP toward the second nozzle surface 37B wipes the first nozzle surface 37A, the gap G is changed to the non-contact interval in the isolation region SA, and the wiping portion 55 is caused to move toward the standby position WP. In other words, the wiping portion 55 wipes the first nozzle surface 37A, moves up to the isolation region SA, and then returns to the standby position WP without being brought into contact with the first nozzle surface 37A. Therefore, it is possible to easily wipe the first nozzle surface 37A out of the first nozzle surface 37A and the second nozzle surface 37B.

(7) The wiping portion 55 passes through the first nozzle surface 37A at the non-contact interval, the gap is changed to the contact interval in the isolation region SA, and the wiping portion 55 then passes through the second nozzle surface 37B and wipes the second nozzle surface 37B.

Therefore, it is possible to easily wipe the second nozzle surface 37B out of the first nozzle surface 37A and the second nozzle surface 37B.

(8) The wiping portion 55 passes through the first nozzle surface 37A and the second nozzle surface 37B at the non-contact interval and returns at the contact interval, thereby wiping the second nozzle surface 37B. Therefore, it is possible to suitably employ the configuration for a case in which the wiping portion 55 wipes the second nozzle surface 37B from the standby position WP at which the first nozzle surface 37A is sandwiched with the second nozzle surface 37B.

(9) After the first nozzle surface 37A is wiped, the portion of the strip-shaped member 46 that serves as the wiping portion 55 is changed, and the second nozzle surface 37B is wiped. Therefore, it is possible to reduce the concern that the performance of the second nozzle surface 37B is degraded due to wiping as compared with a case in which the second nozzle surface 37B is wiped with the portion of the strip-shaped member 46 that has been used to wipe the first nozzle surface 37A.

The embodiment can be carried out with the following modifications. The embodiment and the following modification examples can be carried out in combination with each other as long as no technical conflicts occur.

The first liquid ejecting head 24A and the second liquid ejecting head 24B may be provided such that the first liquid ejecting head 24A and the second liquid ejecting head 24B can move in the ejecting direction Z with respect to the carriage 25. When the first liquid ejecting head 24A is to be wiped, for example, only the first liquid ejecting head 24A may be wiped by causing the first liquid ejecting head 24A to be located at the contact position CP and causing the second liquid ejecting head 24B to be located at the non-contact position NP.

When the second nozzle surface 37B is to be wiped from the standby position WP, the second nozzle surface 37B may be wiped with the wiping portion 55 moving in the transport direction Y. Specifically, the control portion 23 causes the wiping portion 55 to move from the standby position WP toward the second nozzle surface 37B and causes the wiping portion 55 to pass through the first nozzle surface 37A at the non-contact interval. The control portion 23 may set the gap G to the contact interval in the state in which the wiping portion 55 is in the isolation region SA and may cause the wiping portion 55 to move in the transport direction Y and wipe the second nozzle surface 37B.

The wiping portion 55 may be configured of rubber or elastomer, for example. The wiping portion 55 may be configured of a plate-shaped member.

The liquid ejecting apparatus 11 may be configured not to include the wiping solution supply mechanism 32. The wiping solution may not be supplied to the strip-shaped member 46.

The strip-shaped member 46 may be impregnated with the wiping solution in advance.

The wiping solution supply mechanism 32 may supply the wiping solution to the first nozzle surface 37A.

The change in portion of the strip-shaped member 46 that serves as the wiping portion 55 may be performed in a state in which the wiping portion 55 is located at any of the standby position WP, the isolation region SA, and the downstream position DP. The change in portion of the strip-shaped member 46 that serves as the wiping portion 55 may be performed in the process of the wiping portion 55 moving in the transport direction Y or in the direction opposite to the transport direction Y.

The nozzles 36 included in the first nozzle surface 37A and the nozzles 36 included in the second nozzle surface 37B may eject the same liquid.

The nozzles 36 included in the first nozzle surface 37A may eject a treatment solution. The treatment solution is a liquid that cures the liquid ejected from the nozzles 36 included in the second nozzle surface 37B on the medium M.

The gap changing mechanism 67 may cause the wiping portion 55 to move in the ejecting direction Z and in the direction opposite to the ejecting direction Z and change the gap G. The gap changing mechanism 67 may cause the wiping portion 55 to move by causing the pressing roller 52 to move or may cause the wiping portion 55 to move along with the case 47.

The gap changing mechanism 67 may change the positions of the first nozzle surface 37A and the second nozzle surface 37B in the ejecting direction Z in accordance with the thickness of the medium M, for example. The gap changing mechanism 67 may cause the wiping portion 55 to move and change the gap G in accordance with the positions of the first nozzle surface 37A and the second nozzle surface 37B.

The liquid ejecting portion 24 may be caused to move to the maintenance region MA and the ejecting region JA in a state in which the wiping portion 55 is located in the isolation region SA. When wiping is performed during printing, for example, the control portion 23 may cause the liquid ejecting portion 24 to move from the ejecting region JA to the maintenance region MA in the state in which the wiping portion 55 is located in the isolation region SA. The wiping portion 55 located in the isolation region SA may move in the transport direction Y and wipe the second nozzle surface 37B or may move in the direction opposite to the transport direction Y and wipe the first nozzle surface 37A.

After the first nozzle surface 37A or the second nozzle surface 37B is wiped, the control portion 23 may cause the liquid ejecting portion 24 to move from the maintenance region MA to the ejecting region JA in the state in which the wiping portion 55 is located in the isolation region SA.

The liquid ejecting apparatus 11 may be a liquid ejecting apparatus configured to eject or jet a liquid other than the ink. States of the liquid jetted from the liquid ejecting apparatus as a minute amount of liquid droplets include a particle form, a teardrop form, and a form with a string-like tail. The liquid described here may be any material that can be ejected from the liquid ejecting apparatus. For example, the liquid may any substance in a liquid-phase state and includes fluids such as a liquid-form substance with high or low viscosity, a sol, a gel water, another inorganic solvent, an organic solvent, a solution, a liquid resin, a liquid metal, and a molten metal liquid. The liquid includes not only a liquid in one form of a substance but also includes a functional material made of solid such as a pigment or metal particles and dissolved, dispersed, or mixed in a solvent and the like. Representative examples of the liquid include the ink described above in the embodiment, a liquid crystal, and the like. Here, the ink includes various liquid compositions such as a typical water-based ink, an oil-based ink, a gel ink, and a hot melt ink. Specific examples of the liquid ejecting apparatus include a device configured to eject a liquid which contains, in a dispersed or dissolved form, an electrode material, a coloring material, or the like that is used for manufacturing a liquid crystal display, an electroluminescence display, a surface light-emitting display, or a color filter, for example. The liquid ejecting apparatus may be a device configured to eject a bioorganic material used for producing a biochip, a device configured to eject a liquid that is used as a precision pipette and serves as a sample, a printing machine, a micro-dispenser, or the like. The liquid ejecting apparatus may be a device that ejects a lubricant to a precision machine such as a clock or a camera or a device that ejects, onto a substrate, a transparent resin solution such as an ultraviolet curable resin in order to form a micro-hemispherical lens, an optical lens, and the like used in an optical communication device or the like. The liquid ejecting apparatus may be a device configured to eject an acid or alkaline etching solution or the like to etch a substrate or the like.

Next, the wiping solution with which the strip-shaped member 46 is impregnated will be described below in detail.

As the wiping solution, pure water may be employed, or a liquid obtained by containing a preservative in pure water may be employed. As the wiping solution, a liquid with higher surface tension than the surface tension of the liquid that the liquid ejecting portion 24 uses may be employed. For example, a liquid with surface tension of equal to or greater than 40 mN/m and equal to or less than 80 mN/m may be employed as the wiping solution. In this case, it is better to employ a liquid with surface tension of equal to or greater than 60 mN/m and equal to or less than 80 mN/m as the wiping solution.

When the strip-shaped member 46 is impregnated with the wiping solution, the pigment particles are more likely to move from the surface to the inside of the strip-shaped member 46, and the pigment particles are more unlikely to remain on the surface of the strip-shaped member 46. The wiping solution preferably contains a penetrant and a humidifier. In this manner, the pigment particles are more likely to be absorbed by the strip-shaped member 46. Also, the wiping solution is not particularly limited as long as the liquid can cause inorganic pigment particles to move from the surface to the inside of the strip-shaped member 46.

The surface tension of the wiping solution is preferably equal to or less than 45 mN/m and equal to or less than 35 mN/m. When the surface tension is low, permeability of the inorganic pigment into the strip-shaped member 46 becomes satisfactory, and wiping properties are improved. As a method of measuring the surface tension, it is possible to exemplify a method of measuring the surface tension at a liquid temperature of 25° C. by a Wilhelmy method using a surface tension meter that is typically used, for example, a surface tension meter CBVP-Z manufactured by Kyowa Interface Science, Inc. or the like.

The content of the wiping solution is preferably equal to or greater than 10% by mass and equal to or less than 30% by mass with respect to 100% by mass of strip-shaped member 46. By the content of the wiping solution being equal to or greater than 10% by mass, the inorganic pigment ink is likely to penetrate to the inside of the strip-shaped member 46, and it is possible to further curb damage on a water-repellent film. Also, by the content of the wiping solution being equal to or less than 30% by mass, it is possible to further curb remaining of the wiping solution on the first nozzle surface 37A an further to curb dot missing due to invasion of air bubbles with the wiping solution into the nozzles 36 and dot missing due to invasion of the wiping solution itself into the nozzles 36.

In addition, although additives that may be contained in the wiping solution, that is, components of the wiping solution are not particularly limited, examples thereof include a resin, a antifoaming agent, a surfactant, water, an organic solvent, a pH adjusting agent, and the like. One kind among the aforementioned respective components may be used alone, or two or more kinds thereof may be used together, and the content thereof is not particularly limited.

When the wiping solution contains an antifoaming agent, it is possible to effectively prevent the wiping solution remaining on the first nozzle surface 37A after the cleaning treatment from foaming. Also, the wiping solution may contain a large amount of acid humidifier such as polyethylene glycol or glycerin, and in such a case, it is typically possible to avoid contact of an acid wiping solution with a basic ink composition with pH of equal to or greater than 7.5 when the wiping solution contains a pH adjusting agent. In this manner, it is possible to prevent the ink composition from shifting on the acid side, and preservation stability of the ink composition is further maintained.

Also, any humidifier can be used as the humidifier that may be contained in the wiping solution without particular limitation as long as the humidifier can typically be used in an ink or the like. Although the humidifier is not particularly limited, it is possible to use a high-boiling-point humidifier, the boiling point of which is preferably equal to or greater than 180° C. and is more preferably equal to or greater than 200° C. under 1 atm. When the boiling point falls within the aforementioned range, it is possible to prevent volatile components in the wiping solution from being volatilized and to effectively perform wiping by reliably wetting the inorganic pigment-containing ink composition that is brought into contact with the wiping solution.

The high-boiling-point humidifier is not particularly limited, and examples thereof include ethylene glycol, propylene glycol, diethylene glycol, triethylene glycol, pentamethylene glycol, trimethylene glycol, 2-butene-1,4-diol, 2-ethyl-1,3-hexanediol, 2,-methyl-2,4-pentanediol, tripropylene glycol, polyethylene glycol, polypropylene glycol, 1,3-propylene glycol, isopropylene glycol, isobutylene glycol, glycerin, mesoerythritol, pentaerythritol, and the like.

One kind among the humidifiers may be used alone, or two or more kinds thereof may be mixed and used. The content of the humidifier is preferably 10 to 100% by mass with respect to 100% by mass, which is the total mass of the wiping solution. Also, the expression that the content of the humidifier is 100% by mass with respect to the total mass of the wiping solution means that the component of the wiping solution is only the humidifier.

A penetrant among the additives that may be contained in the wiping solution will be described. Any penetrant can be used without particular limitation as long as the penetrant can typically be used in an ink or the like, and it is also possible to employ a solution containing 90% by mass of water and 10% by mass of penetrant with surface tension of equal to or less than 45 mN/m as the penetrant. Although the penetrant is not particularly limited, it is possible to exemplify one or more kinds selected from a group consisting of alkanediols having 5 to 8 carbon atoms, glycol ethers, acetylene glycol-based surfactants, siloxane-based surfactants, and fluorine-based surfactants. Also, the measurement of the surface tension can be performed by the aforementioned method.

Also, the content of the penetrant in the wiping solution is preferably equal to or greater than 1% by mass and equal to or less than 40% by mass and is further preferably equal to or greater than 3% by mass and equal to or less than 25% by mass. There is a trend that more excellent wiping properties are achieved by the content being equal to or greater than 1% by mass, and it is possible to avoid the penetrant attacking the pigment contained in the ink in the vicinity of the nozzles 36, breaking dispersion stability, and causing aggregation, by the content of the penetrant being equal to or less than 40% by mass.

Although the alkanediols having 5 to 8 carbon atoms are not particularly limited, examples thereof include 1,2-pentanediol, 1,5-pentanediol, 1,2-hexanediol, 1,6-hexanediol, 1,2-heptanediol, 2-ethyl-1,3-hexanediol, 2,2-dimethyl-1,3-propanediol, 2,2-dimethyl-1,3-hexanediol, and the like. One kind among the alkanediols having 5 to 8 carbon atoms may be used alone, or two or more kinds thereof may be used together.

Although the glycol ethers are not particularly limited, examples thereof include ethylene glycol mono-n-butyl ether, ethylene glycol mono-t-butyl ether, diethylene glycol mono-n-butyl ether, triethylene glycol mono-n-butyl ether, diethylene glycol mono-t-butyl ether, propylene glycol monomethyl ether, propylene glycol monoethyl ether, propylene glycol mono-t-butyl ether, propylene glycol mono-n-propyl ether, propylene glycol mono-iso-propyl ether, propylene glycol mono-n-butyl ether, dipropylene glycol mono-n-butyl ether, dipropylene glycol mono-n-butyl ether, dipropylene glycol mono-n-propyl ether, dipropylene glycol mono-iso-propyl ether, diethylene glycol dimethyl ether, diethylene glycol diethyl ether, diethylene glycol dibutyl ether, diethylene glycol ethyl methyl ether, diethylene glycol butyl methyl ether, triethylene glycol dimethyl ether, tetraethylene glycol dimethyl ether, dipropylene glycol dimethyl ether, dipropylene glycol diethyl ether, tripropylene glycol dimethyl ether, ethylene glycol monoisohexyl ether, diethylene glycol monoisohexyl ether, triethylene glycol monoisohexyl ether, ethylene glycol monoisoheptyl ether, diethylene glycol monoisoheptyl ether, triethylene glycol monoisoheptyl ether, ethylene glycol monoisooctyl ether, diethylene glycol monoisooctyl ether, triethylene glycol monoisooctyl ether, ethylene glycol mono-2-ethyl hexyl ether, diethylene glycol mono-2-ethyl hexyl ether, triethylene glycol mono-2-ethyl hexyl ether, diethylene glycol mono-2-ethyl pentyl ether, ethylene glycol mono-2-ethyl pentyl ether, ethylene glycol mono-2-ethyl pentyl ether, ethylene glycol mono-2-methyl pentyl ether, diethylene glycol mono-2-methyl pentyl ether, and the like. One kind among the glycol ethers may be used alone, or two or more kinds thereof may be used together.

Although the acetylene glycol-based surfactant is not particularly limited, examples thereof include compounds represented by the following formulae.

(1)

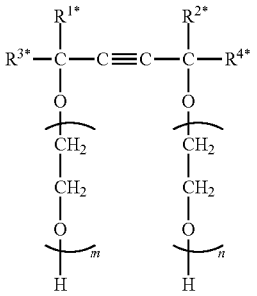

[In Formula (1), $0 \leq m+n \leq 50$, and $R^{1*}$, $R^{2*}$, $R^{3*}$, and $R^{4*}$ each independently represent an alkyl group and preferably represent an alkyl group having 1 to 6 carbon atoms.]

Among the acetylene glycol-based surfactants represented by Formula (1), preferable examples include 2,4,7,9-tetramethyl-5-decyne-4,7-diol, 3,6-dimethyl-4-octyn-3,6-diol, 3,5-dimethyl-1-hexyne-3ol, and the like. Marketed products can also be used as the acetylene glycol-based surfactants represented by Formula (1), and specific examples thereof include Surfynol 82, 104, 440, 465, 485, and TG which are available from Air Products and Chemicals. Inc, Olfine STG manufactured by Nisshin Chemical Co., Ltd., Olfine E1010 manufactured by Nisshin Chemical Co., Ltd., and the like. One kind among the acetylene glycol-based surfactants may be used alone, or two or more kinds thereof may be used together.

Although the siloxane-based surfactants are not particularly limited, examples thereof include those represented by Formula (2) or (3) below.

(2)

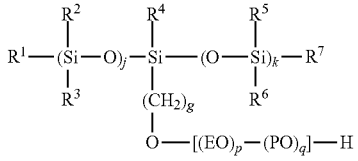

[In Formula (2), $R^1$, $R^2$, $R^3$, $R^4$, $R^5$, $R^6$, and $R^7$ each independently represent an alkyl group having 1 to 6 carbon atoms and preferably represents a methyl group. j and k each independently represent an integer that is equal to or greater than 1, preferably represent 1 to 5, more preferably represent 1 to 4, further preferably represent 1 or 2, and preferably satisfy j=k=1 or k=j+1. Also, g represents an integer that is equal to or greater than 0, preferably represents 1 to 3, and more preferably represents 1. Further, p and q each represent an integer that is equal to or greater than 0 and preferably represent 1 to 5. However, p+q is preferably an integer that is equal to or greater than 1, and p+q is preferably 2 to 4.]

As the siloxane-based surfactants represented by Formula (2), a compound in which all of $R^1$ to $R^7$ represent methyl groups, j represents 1 or 2, k represents 1 or 2, g represents 1 or 2, p represents an integer that is equal to or greater than 1 and equal to or less than 5, and q is 0.

(3)

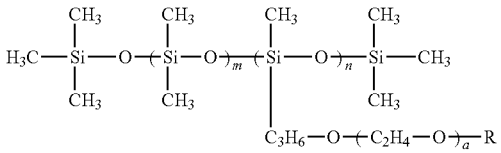

[In Formula (3), R represents a hydrogen atom or a methyl group, a represents an integer from 2 to 18, m represents an integer from 0 to 50, and n represents an integer from 1 to 5.]

Although the siloxane-based surfactants represented by Formula (3) are not particularly limited, preferable examples thereof include compounds in which R represents a hydrogen atom or a methyl group, a represents an integer from 7 to 11, m represents an integer from 30 to 50, and n represents an integer from 3 to 5, compounds in which R represents a hydrogen atom or a methyl group, a represents an integer from 9 to 13, m represents an integer from 2 to 4, and n is an integer that is 1 or 2, compounds in which R represents a hydrogen atom or a methyl group, a represents an integer from 6 to 18, m represents an integer that is 0, and n represents an integer that is 1, and compounds in which R represents a hydrogen atom, a represents an integer from 2 to 5, m represents an integer from 20 to 40, and n represents an integer from 3 to 5.

Commercially available marketed siloxane-based surfactants may also be used, and examples thereof include Olfine PD-501 manufactured by Nisshin Chemical Co., Ltd., Olfine PD-570 manufactured by Nisshin Chemical Co., Ltd., BYK-347 manufactured by BYK Japan KK, BYK-348 manufactured by BYK Japan KK, and the like. One kind among the aforementioned siloxane-based surfactants may be used alone, or two or more kinds thereof may be used together.

The fluorine-based surfactants are known as solvents that exhibit satisfactory wettability with respect to a low-absorbable or unabsorbable medium M as disclosed in WO2010/050618 and WO2011/007888. Although the fluorine-based surfactants are not particularly limited, any fluorine-based surfactant can appropriately be selected in accordance with purposes, and examples thereof include a perfluoroalkylsulfonic acid salt, a perfluoroalkylcarboxylic acid salt, a perfluoroalkylphosphoric acid ester, a perfluoroalkylethylene oxide adduct, perfluoroalkyl betaine, perfluoroalkylamine oxide compound, and the like.

In addition to the aforementioned examples, an appropriately synthesized one may be used, or a marketed product may be used, as the fluorine-based surfactant. Examples of the marketed product include S•144 and S•145 manufactured by AGC Inc.; FC•170C, FC•430, and Fluorad•FC4430 manufactured by 3M Japan Limited; FSO, FSO•100, FSN, FSN•100, and FS•300 manufactured by DuPont; FT•250 and 251 manufactured by Neos Corporation; and the like. Among these, FSO, FSO•100, FSN, FSN•100, and FS•300 manufactured by DuPont are preferably employed. One kind among the fluorine-based surfactants may be used alone, or two or more kinds thereof may be used together.

Next, an ink that is a liquid used by the liquid ejecting portion 24 will be described below in detail.

The ink used by the liquid ejecting apparatus 11 contains a resin in the composition thereof and does not substantially contain glycerin with a boiling point of 290° C. under 1 atm. When the ink substantially contains glycerin, drying properties of the ink are significantly degraded. As a result, not only significant irregularity of concentration in an image on various media M, particularly ink unabsorbable or low-absorbable media M is achieved, but also ink fixability cannot be obtained. Further preferably, the ink does not substantially contain alkyl polyols with a boiling point of equal to or higher than 280° C. under 1 atm, except for the aforementioned glycerin.

Here, "substantially not contain" in the specification means that the substance is not contained exceeding the amount with which addition has sufficient meaning. If this is quantitatively expressed, the content of glycerin is preferably not equal to or greater than 1.0% by mass, is more preferably not equal to or greater than 0.5% by mass, is further preferably not equal to or greater than 0.1% by mass, is further preferably not equal to or greater than 0.05% by mass, and is particularly preferably not equal to or greater than 0.01% by mass with respect to 100% by mass, which is a total mass of the ink. Also, the content of glycerin is most preferably not equal to or greater than 0.001% by mass.

Liquid Repellency

The first nozzle surface 37A and the second nozzle surface 37B may form liquid repellent films. The liquid repellent films are not particularly limited as long as the films have liquid repellency. The liquid repellent films can be formed by forming metal alkoxide molecular films with liquid repellency and then performing drying processing, annealing processing, and the like thereon, for example. Although any metal alkoxide molecular films may be employed as long as the metal alkoxide molecular films have liquid repellency, it is desirable to employ single-molecular films of metal alkoxide having a long-chain polymer group (long-chain RF group) containing fluorine or single-molecular films of metal acid salts having a repellent group (for example, a long-chain polymer group containing fluorine). Although metal alkoxide is not particularly limited, types of metal typically used include, for example, silicon, titanium, aluminum, and zirconium. Examples of the long-chain RF groups include a perfluoroalkyl chain and a perfluoropolyether chain. Examples of alkoxysilane having the long-chain RF group include a silane coupling agent having the long-chain RF group, for example. In addition, it is also possible to use, as the liquid repellent films, silane coupling agent (SCA) films and those disclosed in Japanese Patent No. 4424954, for example.

Although the conductive films may be formed on the surface of the cover member 40, and the liquid repellent films may be formed on the conductive films, underlayer films (plasma polymerized silicone (PPSi) films) may be formed through plasma polymerization of a silicon material first, and the liquid repellent films may be formed on the underlayer films. It is possible to allow the silicon material of the cover member 40 to conform to the liquid repellent films by causing the underlayer films to be interposed therebetween.

The liquid repellent films preferably have a thickness of equal to or greater than 1 nm and equal to or less than 30 nm. If the thickness falls within such a range, the cover member 40 is likely to have more excellent liquid repellency, degradation of the films is relatively delayed, and it is possible to maintain the liquid repellency in a longer period of time. Also, more excellent properties are achieved in terms of costs and easiness in forming the films. Also, the thickness is more preferably equal to or greater than 1 nm and equal to or less than 20 nm and is further preferably equal to or greater than 1 nm and equal to or less than 15 nm in terms of easiness in forming the films.

Ink Composition

Next, an ink composition containing an inorganic pigment (hereinafter, referred to as an inorganic pigment-containing ink composition) and additives (components) that are or may be contained in an ink composition containing a coloring material other than the inorganic pigment (hereinafter, referred to as an inorganic pigment non-containing ink composition) will be described. The ink composition is configured of a coloring material (an inorganic pigment, an organic pigment, a dye, or the like) a solvent (water, an organic solvent, or the like), a resin, a surfactant, and the like.

Coloring Material

The inorganic pigment-containing ink composition contains, as a coloring material, an inorganic pigment in a range of equal to or greater than 1.0% by mass and equal to or less than 20.0% by mass. When the inorganic pigment-containing ink composition is a white ink composition, in particular, the concentration of inorganic pigment is preferably equal to or greater than 5% by mass.

Also, an inorganic pigment non-containing ink composition may contain a coloring material selected from a pigment other than the inorganic pigment and a dye.

Pigment

An average particle diameter of the inorganic pigment contained in the inorganic pigment-containing ink composition is preferably equal to or greater than 20 nm and equal to or less than 250 nm and is more preferably equal to or greater than 20 nm and equal to or less than 200 nm.

Also, a needle shape ratio of the inorganic pigment is preferably equal to or less than 3.0. It is possible to satisfactorily protect the liquid repellent films according to the disclosure of the application by setting such a needle shape ratio. The needle shape ratio is a value obtained by dividing the maximum length of each particle by a minimum width (needle shape ratio=maximum length of particle/minimum width of particle). For specifying the needle shape ratio, it is possible to perform measurement using a transmission-type electronic microscope.

Also, Mohs hardness of the inorganic pigment exceeds 2.0 and is preferably equal to or greater than 5 and equal to or less than 8.

Examples of the inorganic pigment include single metal such as carbon black, gold, silver, copper, aluminum, nickel, and zinc; oxides such as cerium oxide, chromium oxide, aluminum oxide, zinc oxide, magnesium oxide, silicon oxide, tin oxide, zirconium oxide, iron oxide, and titanium oxide; sulfates such as calcium sulfate, barium sulfate, and aluminum sulfate; silicates such as calcium silicate and magnesium silicate; nitrides such as boron nitride and titanium nitride; carbides such as silicon carbide, titanium carbide, boron carbide, tungsten carbide, and zirconium carbide; borides such as zirconium boride and titanium boride; and the like. Examples of the inorganic pigments that are preferable among these include aluminum, aluminum oxide, titanium oxide, zinc oxide, zirconium oxide, silicon oxide, and the like. More preferable examples include titanium oxide, silicon oxide, and aluminum oxide. Titanium oxide of a rutile type has Mohs hardness of about 7 to 7.5 while titanium oxide of an anatase type has Mohs hardness of about 6.6 to 6. Titanium oxide of the rutile type is a preferable crystal system due to low manufacturing costs, and it is also possible to exhibit satisfactory whiteness. Therefore, the liquid ejecting apparatus 11 that has liquid repellent film preservability and is capable of producing a recorded product with satisfactory whiteness at low costs can be obtained when titanium dioxide of the rutile type.

Although the organic pigment is not particularly limited, examples thereof include a quinacridone-based pigment, a quinacridonequinone-based pigment, a dioxazine-based pigment, a phthalocyanine-based pigment, an anthrapyrimidine-based pigment, an anthanthrone-based pigment, an indanthrone-based pigment, a fravanthrone-based pigment, a perylene-based pigment, a diketopyrrolopyrrole-based pigment, a perinone-based pigment, a quinophthalone-based pigment, an anthraquinone-based pigment, a thioindigo-based pigment, a benzimidazolone-based pigment, an isoindolinone-based pigment, an azomethine-based pigment, an azo-based pigment, and the like. Specific examples of the organic pigment include ones listed below.

Examples of a pigment that is used in a cyan ink include C.I. Pigment Blue 1, 2, 3, 15, 15:1, 15:2, 15:3, 15:4, 15:6, 15:34, 16, 18, 22, 60, 65, 66, C.I. Vat Blue 4 and 60, and the like. Among these, at least either C.I. Pigment Blue 15:3 or 15:4 is preferably employed.

Examples of a pigment that is used in a magenta ink include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48 (Ca), 48 (Mn), 57 (Ca), 57:1, 88, 112, 114, 122, 123, 144, 146, 149, 150, 166, 168, 170, 171, 175, 176, 177, 178, 179, 184, 185, 187, 202, 209, 219, 224, 245, 254, and 264, C.I. Pigment Violet 19, 23, 32, 33, 36, 38, 43, and 50, and the like. Among these, one or more kinds selected from a group consisting of C.I. Pigment Red 122, C.I. Pigment Red 202, and C.I. Pigment Violet 19 are preferably employed.

Examples of a pigment used in a yellow ink include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 155, 167, 172, 180, 185, and 213 and the like. Among these, one or more kinds selected from a group consisting of C.I. Pigment Yellow 74, 155, and 213 are preferably employed.

Also, examples of a pigment used in an ink of a color other than the aforementioned colors, such as a green ink or an orange ink, include ones that are known in the related art.

An average particle diameter of the pigment other than the inorganic pigment is preferably equal to or less than 250 nm since it is possible to curb clogging of the nozzles 36 and to achieve further satisfactory ejection stability.

Also, the average particle diameter in the specification is on the basis of volume. As a measurement method, it is possible to perform the measurement using a granularity distribution measurement device employing a laser diffraction scattering method as a measurement principle, for example. Examples of the granularity distribution measurement device include a granularity distribution meter (for example, Microtrac UPA manufactured by Nikkiso Co., Ltd.) employing a dynamic light scattering method as a measurement principle.

Dye

It is possible to use a dye as the coloring material. The dye is not particularly limited, and it is possible to use an acidic dye, a direct dye, a reactive dye, and a basic dye.

The content of the coloring material is preferably 0.4 to 12% by mass and is more preferably 2 to 5% by mass with respect to the total mass (100% by mass) of the ink composition.

Resin

Examples of the resin include a resin dispersant, a resin emulsion, a wax, and the like. Among these, an emulsion is preferably employed due to its satisfactory adhesiveness and rubbing resistance.

The inorganic pigment-containing ink composition preferably has the following feature (1) or (2) in terms of the composition.

(1) The ink jet recording ink composition contains a first resin with a thermal deformation temperature of equal to or lower than 10° C. (hereinafter, referred to as a "first ink").

(2) The ink jet recording ink composition contains a second resin and substantially does not contain glycerin (hereinafter, referred to as a "second ink").

Although these ink compositions have a characteristic that the ink compositions are likely to be solidified on the first nozzle surface 37A, the second nozzle surface 37B, and the strip-shaped member 46, and are likely to promote damage on the liquid repellent films, it is possible to satisfactorily prevent such trends.

The aforementioned first ink contains the first resin with the thermal deformation temperature of equal to or lower than 10° C. Such a resin has a characteristic that the resin fixedly adheres to a material with flexibility and absorbability such as a fabric. Meanwhile, film coating and solidification rapidly advance, and the resin adheres, as a solid, to the first nozzle surface 37A, the second nozzle surface 37B, the strip-shaped member 46, and the like.

The aforementioned second ink substantially does not contain glycerin with a boiling point of 290° C. under 1 atm. When the colored ink substantially contains glycerin, drying properties of the ink are significantly degraded. As a result, not only significant irregularity of concentration in an image on various media M, particularly ink unabsorbable or low-absorbable media M is achieved, but also ink fixability cannot be obtained. Also, when glycerin is not contained, water and the like as a main solvent in the ink is rapidly volatilized, and the proportion of the organic solvent in the second ink increases. In this case, the thermal deformation temperature (particularly, a film increasing temperature) of the resin is lowered as a result, and solidification due to coated film is further promoted. Further preferably, the colored ink substantially does not contain alkylpolyols (except for glycerin described above) with a boiling point of equal to or higher than 280° C. under 1 atm. Although in the case of the second ink, drying of the ink around the liquid ejecting portion 24 advances, and the problem further significantly appears in a case of the liquid ejecting apparatus 11 provided with a heating mechanism configured to heat the medium M that has been transported to a position that faces the liquid ejecting portion 24, it is possible to satisfactorily prevent this according to the disclosure of the application. The heating temperature is preferably equal to or greater than 30° C. and equal to or less than 80° C. in terms of ink preservation stability and recorded image quality. The heating mechanism is not particularly limited, and examples thereof include a heat generating heater, a hot wind heater, an infrared heater, and the like.

Here, "substantially not contain" in the specification means that the substance is not contained exceeding the amount with which addition has sufficient meaning. If this is quantitatively expressed, the content of glycerin is preferably not equal to or greater than 1.0% by mass, is more preferably not equal to or greater than 0.5% by mass, is further preferably not equal to or greater than 0.1% by mass, is further preferably not equal to or greater than 0.05% by mass, is particularly preferably not equal to or greater than 0.01% by mass, and is the most preferably not equal to or greater than 0.001% by mass with respect to the total mass (100%) by mass of the colored ink.

A thermal deformation temperature of the first resin is preferably equal to or lower than 10° C. Further, the thermal deformation temperature is preferably equal to or lower than −10° C. and is more preferably equal to or less than −15° C. When a glass transition temperature of a fixation resin falls within the aforementioned range, further excellent fixability of the pigment in a recorded product is achieved, and as a result, excellent rubbing resistance is achieved. Also, although a lower limit of the thermal deformation temperature is not particularly limited, the lower limit may be equal to or greater than −50° C.

A lower limit of the thermal deformation temperature of the second resin is preferably equal to or higher than 40° C. and is more preferably equal to or higher than 60° C. in order to reduce clogging of the head and to achieve satisfactory rubbing resistance of the recorded product. A preferable upper limit is equal to or lower than 100° C.

Here, the "thermal deformation temperature" in the specification is assumed to be a temperature value represented by a glass transition temperature (Tg) or a minimum film forming temperature (MFT). In other words, "the thermal deformation temperature of equal to or higher than 40° C." means that it is only necessary for either Tg or MFT to be equal to or higher than 40° C. Also, since it is easier to recognize relative merits of re-dispersibility of the resin with MFT than with Tg, the thermal deformation temperature is preferably a temperature value represented by MFT. Since the ink composition with excellent resin re-dispersibility does not adhere in a solidified manner, the head is unlikely to cause clogging.

As Tg in the specification, a value measured by differential scanning calorimetry will be described. Also, a value measured on the basis of ISO 2115:1996 (title: plastic-polymer dispersion-measurement of white point temperature and minimum film forming temperature) will be described as MFT in the specification.

Resin Dispersant

Since the pigment can be stably dispersed and held in water when the ink composition contains the aforementioned pigment, it is better for the ink composition to contain a resin dispersant. By the ink composition containing the pigment dispersed using the resin dispersant, such as a water-soluble resin or a water dispersible resin (hereinafter, referred to as a "resin dispersed pigment"), it is possible to obtain satisfactory adhesiveness at least either between the medium M and the ink composition or between solidified substances in the ink composition when the ink composition adheres to the medium M. The water-soluble resin is preferably employed among the resin dispersants due to its excellent dispersion stability.

Resin Emulsion

The ink composition may contain a resin emulsion. The resin emulsion exhibits an effect that the ink composition is sufficiently fixed to the medium M and satisfactory rubbing resistance of the image is achieved, by forming a resin coating film. A product recorded using the ink composition containing the resin emulsion has excellent adhesiveness and rubbing resistance on a cloth or an ink unabsorbable or low-absorbable medium M, in particular, due to the aforementioned effect. Meanwhile, although the resin emulsion is likely to promote solidification of the inorganic pigment, it is possible to satisfactorily prevent a problem of degradation of the liquid repellent films, which occurs when a solidified adhering substance is wiped, according to the disclosure of the application.

Also, the resin emulsion that serves as a binder is preferably contained in an emulsion form in the ink composition. The viscosity of the ink composition is easily adjusted in a proper range in the ink jet recording scheme, and excellent preservation stability and ejection stability of the ink composition are achieved by containing the resin that serves as a binder in an emulsion form in the ink composition.

Although the resin emulsion is not particularly limited, examples thereof include (meth)acrylic acid, (meth)acrylic acid ester, acrylonitrile, cyanoacrylate, acrylamide, olefin, styrene, vinyl acetate, vinyl chloride, vinyl alcohol, vinyl ether, vinyl pyrrolidone, vinyl pyridine, vinyl carbazole, vinyl imidazole, a single polymer or a copolymer of vinylidene chloride, a fluorine resin, a natural resin, and the like. Among these, at least either a (meth)acrylic resin or styrene-(meth)acrylic acid copolymer-based resin is preferably employed, at least either the acrylic resin or a styrene-acrylic acid copolymer-based resin is more preferably employed, and a styrene-acrylic acid copolymer-based resin is further preferably employed. Also, the aforementioned copolymer may be in any form among a random copolymer, a block copolymer, an alternating copolymer, and a graft copolymer.

As the resin emulsion, a marketed product may be used, or the resin emulsion may be produced using an emulsion polymerization method or the like as follows. As a method for obtaining a resin in an emulsion state in the ink composition, it is possible to exemplify a method of emulsifying and polymerizing a monomer of the aforementioned water-soluble resin in water in which a polymerization catalyst and an emulsifier are present. A polymerization initiator, an emulsifier, and a molecular weight adjusting agent used for emulsification polymerization can be used in accordance with a method that is known in the related art.

An average particle diameter of the resin emulsion is preferably within a range of 5 nm to 400 nm and is more preferably within a range of 20 nm to 300 nm in order to achieve further satisfactory ink preservation stability and ejection stability.

One kind among the resin emulsions may be used alone, or two or more kinds thereof may be used in combination. The content of the resin emulsion in the resin is preferably within a range of 0.5 to 15% by mass with respect to the total mass (100% by mass) of the ink composition. When the content falls within the aforementioned range, it is possible to reduce the concentration of the solid content and thereby to achieve further satisfactory ejection stability.

Wax

The ink composition may contain a wax. The ink composition have more excellent fixability on the ink unabsorbable and low-absorbable media M by containing the wax. Among waxes, a wax of an emulsion type or a suspension type is more preferably employed. Preferable examples of the wax include a polyethylene wax, a paraffine wax, and a polypropylene wax, and in particular, a polyethylene wax, which will be described later, is preferably employed although not limited thereto.

It is possible to achieve excellent ink rubbing resistance by the ink composition containing a polyethylene wax.

An average particle diameter of the polyethylene wax is preferably within a range of 5 nm to 400 nm and is more preferably within a range of 50 nm to 200 nm in order to achieve further satisfactory ink preservation stability and ejection stability.

The content (in terms of solid content) of polyethylene wax is preferably within a range of 0.1 to 3% by mass, is more preferably within a range of 0.3 to 3% by mass, and is further preferably within a range of 0.3 to 1.5% by mass with respect to the total mass (100% by mass) of the ink composition. When the content falls within the aforementioned range, it is possible to satisfactorily solidify and fix the ink composition on and to the medium M and to achieve more excellent ink preservation stability and ejection stability.

Antifoaming Agent

The ink composition may contain an antifoaming agent. More specifically, at least either the ink composition or the cleaning solution included in the wiping portion 55 may contain the antifoaming agent. When the ink composition contain the antifoaming agent, it is possible to curb foaming and, as a result, to reduce the concern that foam enters the nozzles 36.

Examples of the antifoaming agent include a silicon-based antifoaming agent, a polyether-based antifoaming agent, an aliphatic acid ester-based antifoaming agent, an acetylene glycol-based antifoaming agent, and the like although not limited thereto. Among these, the silicon-based antifoaming agent or an acetylene glycol-based antifoaming agent is preferably employed since they have excellent ability of appropriately keeping the surface tension and interfacial tension and substantially no air bubbles are generated. Also, an HLB value of the antifoaming agent based on a Griffin method is more preferably equal to or less than 5.

Surfactant

The ink composition may contain a surfactant (except for those listed as the aforementioned antifoaming agent; that is, the surfactant is limited to those with an HLB value based on the Griffin method exceeding 5). Examples of the surfactant include nonionic surfactants although not limited to those listed below. The nonionic surfactants have an effect of uniformly spreading the ink on the medium M. Therefore, it is possible to obtain a fine image with substantially no bleeding when ink jet recording is performed using an ink containing a nonionic surfactant. Examples of such a nonionic surfactant include a silicon-based surfactant, a polyoxyethylene alkyl ether-based surfactant, a polyoxypropylene alkyl ether-based surfactant, a polycyclic phenyl ether-based surfactant, a sorbitan derivative, a fluorine-based surfactant, and the like although not limited thereto, and among these, a silicon-based surfactant is preferably employed.

The silicone-based surfactant has an excellent effect of uniformly spreading the ink such that no bleeding occurs on the medium M as compared with other nonionic surfactants.

One kind among the surfactants may be used alone, or two or more kinds thereof may be mixed and used. The content of the surfactant is preferably equal to or greater than 0.1% by mass and equal to or less than 3% by mass with respect to the total mass (100% by mass) of the ink since further satisfactory ink preservation stability and ejection stability are achieved.

Water

The ink composition may contain water. When the ink composition is a water-based ink, in particular, water is a main component of the ink, and the component is evaporated and flies over when the medium M is heated in ink jet recording.

Examples of water include pure water such as ion exchanged water, ultrafiltration water, reverse osmotic water, and distilled water and water from which ionic impurities have been removed to the maximum extent, such as ultrapure water. Also, when water sterilized by irradiation with ultraviolet rays, addition of hydrogen peroxide, or the like is used, it is possible to prevent mold and bacteria from being generated when the pigment dispersion and the ink using it are preserved for a long period of time.

The content of water is not particularly limited and may appropriately be determined as needed.

Surface Tension of Ink Composition

Surface tension of the ink composition is not particularly limited and is preferably 15 to 35 mN/m. In this manner, it is possible to secure permeability of the ink composition into the strip-shaped member 46 and bleeding preventing properties at the time of recording, and ink wiping properties at the time of a cleaning operation is improved. A measurement method using a typically used surface tension meter (for example, a surface tension meter CBVP-Z manufactured by Kyowa Interface Science, Inc. or the like) as described above for the surface tension of the ink composition as well. Also, a difference between the surface tension of the ink composition and the surface tension of the cleaning solution is preferably in a relationship within 10 mN/m. In this manner, it is possible to prevent the surface tension of the ink composition from extremely decreasing when both the ink composition and the cleaning solution are mixed around the nozzles 36.

Hereinafter, technical ideas and effects and advantages thereof that can be understood from the aforementioned embodiment and modification examples will be described.

(A) A liquid ejecting apparatus includes: a liquid ejecting portion on which a first nozzle surface and a second nozzle surface are provided at an interval, the first nozzle surface and the second nozzle surface each being provided with nozzles that eject liquid; a wiping mechanism that has a wiping portion configured to wipe the first nozzle surface and the second nozzle surface and in which the wiping portion moves in a wiping direction in which the first nozzle surface and the second nozzle surface are aligned to perform wiping; and a gap changing mechanism configured to change a gap between the first and second nozzle surfaces and the wiping portion in an ejecting direction, in which the liquid is ejected from the nozzles, between a contact interval at which the first nozzle surface and the second nozzle surface are wiped and a non-contact interval at which the first nozzle surface and the second nozzle surface are not in contact with the wiping portion, in which the interval includes an isolation region in which the wiping portion is not brought into contact with the first nozzle surface and the second nozzle surface when the gap is the contact interval, and which is provided between the first nozzle surface and the second nozzle surface in the wiping direction.

With this configuration, the isolation region is provided between the first nozzle surface and the second nozzle surface in the wiping direction. The wiping portion positioned in the isolation region is not brought into contact with the first nozzle surface and the second nozzle surface even when the gap is the contact interval. Therefore, the gap changing mechanism can easily wipe either the first nozzle surface or the second nozzle surface by changing the gap in a state in which the wiping portion is positioned in the isolation region.

(B) The liquid ejecting apparatus may further include a liquid ejecting portion moving mechanism that causes the liquid ejecting portion to move in a scanning direction, the liquid ejecting portion may move between a maintenance region in which the wiping mechanism is disposed and an ejecting region in which the liquid is ejected from the nozzles to a medium, the wiping direction may follow a transport direction in which the medium is transported and intersect the scanning direction, and the isolation region may be provided such that the liquid ejecting portion is configured to move in the scanning direction between the maintenance region and the ejecting region when the gap is the contact interval and the wiping portion is positioned in the isolation region.

The wiping may be performed in the process of printing. With this configuration, the liquid ejecting portion can move in the maintenance region and the ejecting region in the state in which the gap is the contact interval and the wiping portion is positioned in the isolation region. When the wiping portion moves from the standby position to the isolation region and wipes the first nozzle surface, for example, the wiping portion is positioned in the isolation region after the wiping. Since the liquid ejecting portion can move to the ejecting region in the state in which the wiping portion is positioned in the isolation region, it is possible to reduce a time required for wiping as compared with a case in which the wiping portion is returned to the standby position and the liquid ejecting portion is then moved to the ejecting region, for example.

(C) According to the liquid ejecting apparatus, the gap changing mechanism may cause the liquid ejecting portion to move in the ejecting direction and change the gap between the contact interval and the non-contact interval, a standby position of the wiping portion may be positioned further upstream than the first nozzle surface in the transport direction, the first nozzle surface may be positioned further upstream than the second nozzle surface in the transport direction, the nozzles that eject a first liquid, which is the liquid, may be provided in the first nozzle surface such that the nozzles are aligned and form a nozzle array in the transport direction, and the nozzles that eject a second liquid, which is the liquid, may be provided in the second nozzle surface such that the nozzles are aligned and form a nozzle array in the transport direction.

With this configuration, the gap changing mechanism causes the liquid ejecting portion to move in the ejecting direction. Therefore, the gap changing mechanism can also cause the liquid ejecting portion to move in accordance with, for example, a thickness of the medium. In other words, it is possible to change the gap of the first nozzle surface, the second nozzle surface, and the wiping portion using a mechanism configured to adjust the interval of the first nozzle surface, the second nozzle surface, and the medium.

(D) According to the liquid ejecting apparatus, the liquid ejecting apparatus may further include a wiping solution supply mechanism that supplies a wiping solution to the wiping portion before the first nozzle surface is wiped the liquid ejected from the nozzles included in the first nozzle surface may be a first liquid, the liquid ejected from the nozzles included in the second nozzle surface may be a second liquid, and the first liquid may contain a component with hardness higher than hardness of a component contained in the second liquid.

The liquid may fly after being ejected from the nozzles and adhere to a periphery of the nozzles. The first liquid is likely to adhere to the first nozzle surface provided with the nozzles configured to eject the first liquid, and the second liquid is likely to adhere to the second nozzle surface provided with the nozzles configured to eject the second liquid. With this configuration, the wiping solution supply mechanism supplies the wiping solution to the wiping portion before the first nozzle surface is wiped. The wiping portion dilutes components in the first liquid with the wiping solution and wipes the first nozzle surface. Therefore, it is possible to achieve a state in which the components in the first liquid are unlikely to rub the first nozzle surface. Therefore, it is possible to reduce a concern that performance of the first nozzle surface is degraded due to wiping when surface treatment such as liquid-repellent treatment, for example, is performed on the first nozzle surface.

(E) According to the liquid ejecting apparatus, the wiping portion may be a part of a strip-shaped member included in the wiping mechanism, the part being brought into contact with either the first nozzle surface or the second nozzle surface, and the wiping mechanism may hold the strip-shaped member such that the part that serves as the wiping portion in the strip-shaped member is changeable.

With this configuration, a part of the strip-shaped member configures the wiping portion. The part of the strip-shaped member that serves as the wiping portion can be changed. Therefore, it is possible to reduce the concern that the performance of the first nozzle surface and the second nozzle surface is degraded due to the wiping as compared with a case in which wiping is repeatedly performed using the same part.

(F) A maintenance method for a liquid ejecting apparatus that includes a liquid ejecting portion on which a first nozzle surface and a second nozzle surface are provided at an interval, the first nozzle surface and the second nozzle surface each being provided with nozzles that eject liquid, a wiping mechanism that has a wiping portion configured to wipe the first nozzle surface and the second nozzle surface and in which the wiping portion moves in a wiping direction in which the first nozzle surface and the second nozzle surface are aligned to perform wiping, and a gap changing mechanism configured to change a gap between the first and second nozzle surfaces and the wiping portion in an ejecting direction, in which the liquid is ejected from the nozzles, between a contact interval at which the first nozzle surface and the second nozzle surface are wiped and a non-contact interval at which the first nozzle surface and the second nozzle surface are not in contact with the wiping portion, in which the interval include an isolation region in which the wiping portion is not brought into contact with the first nozzle surface and the second nozzle surface when the gap is the contact interval, and which is provided between the first nozzle surface and the second nozzle surface in the wiping direction, the method includes, when the first nozzle surface positioned between a standby position and the second nozzle surface in the wiping direction is wiped, causing the wiping portion to move from the standby position toward the second nozzle surface, causing the wiping portion to pass through the first nozzle surface at the contact interval to wipe the first nozzle surface, then changing the gap to the non-contact interval in the isolation region, and causing the wiping portion to move toward the standby position.

With this configuration, the first nozzle surface is wiped with the wiping portion that moves from the standby position toward the second nozzle surface, the gap is then changed to the non-contact interval in the isolation region, and the wiping portion is caused to move toward the standby position. In other words, the wiping portion wipes the first nozzle surface, moves up to the isolation region, and then returns to the standby position without being brought into contact with the first nozzle surface. Therefore, it is possible to easily wipe the first nozzle surface out of the first nozzle surface and the second nozzle surface.

(G) According to the maintenance method for a liquid ejecting apparatus, when the second nozzle surface is wiped, the wiping portion may be caused to move from the standby position toward the second nozzle surface and to pass through the first nozzle surface at the non-contact interval, the gap may then be changed to the contact interval, and the second nozzle surface may be wiped.

With this configuration, the wiping portion passes through the first nozzle surface at the non-contact interval, the gap is changed to the contact interval in the isolation region, and the wiping portion then passes through the second nozzle surface and wipes the second nozzle surface. Therefore, it is possible to easily wipe the second nozzle surface out of the first nozzle surface and the second nozzle surface.

(H) According to the maintenance method for a liquid ejecting apparatus, when the second nozzle surface is wiped, the wiping portion may be caused to move from the standby position toward the second nozzle surface and to pass through the first nozzle surface and the second nozzle surface at the non-contact interval, the gap may be then changed to the contact interval, and the wiping portion may be caused to move toward the first nozzle surface and to wipe the second nozzle surface.

With this configuration, the wiping portion passes through the first nozzle surface and the second nozzle surface at the non-contact interval and then returns at the contact interval, thereby wiping the second nozzle surface. Therefore, it is possible to suitably employ the configuration to a case in which the wiping portion wipes the second nozzle surface from the standby position with the first nozzle surface sandwiched with the second nozzle surface.

(I) According to the maintenance method for a liquid ejecting apparatus, the wiping portion may be a part of a strip-shaped member included in the wiping mechanism, the part being brought into contact with either the first nozzle surface or the second nozzle surface, the wiping mechanism holds the strip-shaped member such that the part that serves as the wiping portion in the strip-shaped member is changeable, and when the first nozzle surface and the second nozzle surface are wiped, the wiping portion may be caused to move from the standby position toward the second nozzle surface and to pass through the first nozzle surface at the contact interval to wipe the first nozzle surface, the gap may be changed to the non-contact interval in the isolation region, the wiping portion may be caused to pass through the second nozzle surface, the part that serves as the wiping portion in the strip-shaped member may then be changed and the gap may be changed to the contact interval, and the wiping portion may be caused to move toward the first nozzle surface and to wipe the second nozzle surface.

With this configuration, the part of the strip-shaped member that serves as the wiping portion is changed after the first nozzle surface is wiped, and the second nozzle surface is then wiped. Therefore, it is possible to reduce the concern that performance of the second nozzle surface is degraded due to the wiping as compared with a case in which the second nozzle portion is wiped with the part of the strip-shaped member that has been used to wipe the first nozzle surface.

What is claimed is:

1. A liquid ejecting apparatus comprising:

a liquid ejecting portion on which a first nozzle surface and a second nozzle surface are provided so as to be aligned in a wiping direction, and so that the first nozzle surface and the second nozzle surface are spaced by an interval in the wiping direction, the first nozzle surface and the second nozzle surface each being provided with nozzles that eject liquid in an ejecting direction;

a wiping mechanism that has a wiping portion configured to wipe the first nozzle surface and the second nozzle surface, the wiping portion configured to move in the wiping direction in which the first nozzle surface and the second nozzle surface are aligned to thereby cause the wiping portion to perform wiping; and a gap changing mechanism configured to change a gap between the wiping portion and each of the first and second nozzle surfaces in the ejecting direction, the changing of the gap being between a contact distance at which the first nozzle surface and the second nozzle surface are wiped and a non-contact distance at which the first nozzle surface and the second nozzle surface are not in contact with the wiping portion, wherein the wiping portion is configured to stay in an isolation region within the interval even during some times that the liquid ejecting portion is ejecting the liquid, the wiping portion located within the isolation region is not in contact with either of the first nozzle surface or the second nozzle surface even if the gap is at the contact distance.

2. The liquid ejecting apparatus according to claim 1, further comprising a liquid ejecting portion moving mechanism configured to cause the liquid ejecting portion to move in a scanning direction, wherein the liquid ejecting portion is configured to move between a maintenance region in which the wiping mechanism is disposed and an ejecting region in which the liquid is ejected from the nozzles to a medium, the wiping direction follows a transport direction in which the medium is configured to be transported, and intersects the scanning direction, and the isolation region is provided such that the liquid ejecting portion is configured to move in the scanning direction between the maintenance region and the ejecting region when the gap is the contact distance and the wiping portion is positioned in the isolation region.

3. The liquid ejecting apparatus according to claim 2, wherein the gap changing mechanism is configured to cause the liquid ejecting portion to move in the ejecting direction and is configured to change the gap between the contact distance and the non-contact distance, a standby position of the wiping portion is configured to be positioned further upstream than the first nozzle surface in the transport direction, the first nozzle surface is configured to be positioned further upstream than the second nozzle surface in the transport direction, the nozzles that eject a first liquid, which is the liquid, are configured to be provided in the first nozzle surface such that the nozzles are aligned and form a nozzle array in the transport direction, and the nozzles that eject a second liquid, which is the liquid, are configured to be provided in the second nozzle surface such that the nozzles are aligned and form a nozzle array in the transport direction.

4. The liquid ejecting apparatus according to claim 1, further comprising:

a wiping solution supply mechanism configured to supply a wiping solution to the wiping portion before the first nozzle surface is wiped, wherein the liquid ejected from the nozzles included in the first nozzle surface is a first liquid, the liquid ejected from the nozzles included in the second nozzle surface is a second liquid, and the first liquid contains a component with hardness higher than hardness of a component contained in the second liquid.

5. The liquid ejecting apparatus according to claim 1, wherein the wiping portion is a part of a strip-shaped member configured to be included in the wiping mechanism, the part being brought into contact with either the first nozzle surface or the second nozzle surface, and the wiping mechanism is configured to holds the strip-shaped member such that the part that serves as the wiping portion in the strip-shaped member is changeable.

* * * * *